US006656670B2

(12) United States Patent
Sato et al.

(10) Patent No.: US 6,656,670 B2
(45) Date of Patent: Dec. 2, 2003

(54) SILVER HALIDE COLOR PHOTOGRAPHIC MATERIAL AND METHOD OF FORMING COLOR REVERSAL IMAGE

(75) Inventors: Minoru Sato, Tokyo (JP); Masayuki Kuramitsu, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/098,438

(22) Filed: Mar. 18, 2002

(65) Prior Publication Data

US 2003/0077548 A1 Apr. 24, 2003

(30) Foreign Application Priority Data

Mar. 19, 2001 (JP) ..... 2001-079388
Jan. 16, 2002 (JP) ..... 2002-007794

(51) Int. Cl.[7] ..... G03C 1/46
(52) U.S. Cl. ..... 430/504
(58) Field of Search ..... 430/504

(56) References Cited

U.S. PATENT DOCUMENTS 5,464,733 A * 11/1995 Friday ..... 430/507
5,932,401 A 8/1999 Chen
6,159,672 A * 12/2000 Rieger et al. ..... 430/506

FOREIGN PATENT DOCUMENTS

JP 2-272450 11/1990

* cited by examiner

*Primary Examiner*—Hoa Van Le
(74) *Attorney, Agent, or Firm*—Sughrue Mion, PLLC

(57) ABSTRACT

A silver halide color photographic material includes at least one blue-sensitive emulsion layer, at least one green-sensitive emulsion layer and at least one red-sensitive emulsion layer, on a support. The photographic material further includes at least one short-wavelength blue-sensitive emulsion layer that has a weight-averaged wavelength ($\lambda v$) of spectral sensitivity distribution of 400 nm$\leqq\lambda v\leqq$460 nm and that is substantially free a yellow coupler.

16 Claims, No Drawings

SILVER HALIDE COLOR PHOTOGRAPHIC MATERIAL AND METHOD OF FORMING COLOR REVERSAL IMAGE

CROSS-REFERENCE TO RELATED APPLICATIONS

This application is based upon and claims the benefit of priority from the prior Japanese Patent Applications No. 2001-079388, filed Mar. 19, 2001; and No. 2002-007794, filed Jan. 16, 2002, the entire contents of both of which are incorporated herein by reference.

BACKGROUND OF THE INVENTION

1. Field of the Invention

The present invention relates to a color photographic material, specifically a color reversal photographic material, and more specifically to a silver halide color photographic material, which is good in hue discrimination of intermediate color, particularly from blue to purple colors and high in imaging power, and a method of forming a color reversal image.

2. Description of the Related Art

In a color photographic material, if the improvement of saturation is limited to the primary colors, such an improvement can be realized by lessening the overlap of spectral sensitivity distribution of blue-, green- and red-lightsensitive emulsion layers, but in this case, the reproduction of intermediate colors is deteriorated (for example, see Satoru Honjou, "Characteristics and Technique of Color Reversal Film", Journal of Japan Photography Academy, Vol. 48, p. 274 (1985)). Jpn. Pat. Appln. KOKAI Publication No. (hereinafter referred to as JP-A-) 2-272450, JP-A's-2-272540 and 3-122636 disclose that a color photographic material having a silver halide emulsion layer which releases a development inhibitor in a black-and-white development and which thus does not substantially contribute to the formation of a coloring dye is effective in order to improve the saturation of color reproduction of a color reversal photographic material and the fidelity of hue including intermediate colors. However, according to these techniques, although the improvement of the saturation of the primary colors and the discrimination from blue to green are superior, there is a problem in the fidelity of the intermediate color. It is necessary to solve this problem.

As a technique for improving the color reproduction, U.S. Pat. Nos. 4,663,271, 4,705,744 and 4,707,436, JP-A's-62-160448 and 63-89850 disclose that a donor layer with an inter-image effect having a spectral sensitivity distribution different from those of blue-, green- and red-lightsensitive layers is arranged. Although these are superior inventions, there is almost no specific description for realizing this in the system of a color reversal photographic material. It has been found that even if the color reversal photographic material is fabricated by such configuration, the inter-image effect from the donor layer is not adequately expressed, and the coloring layer provided near the donor layer is influenced, resulting in that the colors of a subject cannot be adequately and faithfully reproduced.

Further, JP-A's-2-272450, 2-272540, 3-122636 and 8-328212 disclose a method of providing a donor layer of an inter-image effect and a method of setting spectral sensitivity in a silver halide color photographic material. However, it has been found that since the inter-image effect from the donor layer is not adequately expressed even by these configurations and a color-sensitive coloring layer provided near the donor layer generates an unnecessary coloring and color impurities by the emulsion which the donor layer contains, the color of a subject cannot be adequately and faithfully reproduced.

JP-A's-4-039653 and 4-039654 disclose techniques concerning the gradation design of a color reversal film for improving the flesh tone (corresponding to Macbeth color chart No. 2 light-skin) reproduction. However, these techniques are designed to optimize the color reproduction of only the flesh tone by "lowering the slope of magenta to yellow in a D-log E curve", which results in a serious disadvantage that the gray color tone is changed by the concentration. There is no description in these documents at all concerning a technique of remedying the disadvantage noted above. Further, these techniques are directed to the stabilization of the change of flesh tones differing in concentration. Nothing is taken into consideration concerning the improvement of discrimination of various intermediate colors in the above-mentioned documents.

Further, the above-mentioned conventional techniques are insufficient for discriminating the intermediate colors, in particular, from blue to purple colors.

Accordingly, it has been desired to develop a technique concerning a color photographic material, which is superior in hue discrimination of intermediate colors, particularly from blue to purple colors

BRIEF SUMMARY OF THE INVENTION

It is an object of the present invention to provide a color photographic material, particularly, a color reversal photographic material, which provides an improved hue discrimination of intermediate colors, particularly, from blue to purple colors, and a method of forming a color reversal image.

According to an aspect of the present invention, there is provide a silver halide color photographic material comprising at least one blue-sensitive emulsion layer, at least one green-sensitive emulsion layer and at least one red-sensitive emulsion layer, on a support, which further includes at least one short-wavelength blue-sensitive emulsion layer (VL layer) that has a weight-averaged wavelength ($\lambda v$) of spectral sensitivity distribution of $400\ nm \leqq \lambda v \leqq 460\ nm$ and that is substantially free of a yellow coupler.

In an embodiment, the average silver iodide content of the silver halide grains contained in the VL layer is 2 mol % or more and 39 mol % or less.

In an embodiment, the VL layer may contain a cyan coupler.

In an embodiment, a non-lightsensitive fine grain emulsion may be present in the VL layer or in an adjacent layer thereof.

According to another aspect of the present invention, a method of forming a color reversal image is provided which comprises subjecting a silver halide color photographic material according to the present invention to a black-and-white development, and then to a color development.

DETAILED DESCRIPTION OF THE INVENTION

The "weight-averaged wavelength ($\lambda v$) of spectral sensitivity distribution" as used herein is intended to mean a weight-averaged wavelength of spectral sensitivity determined from the spectral sensitivity distribution $Sv(\lambda)$ of a short-wavelength blue-sensitive emulsion layer. This can be determined by peeling every layer in the photographic material after coating, and measuring the spectral absorption property. In many cases, since it is caused by the absorption of J-associate of a spectral sensitizing dye in the emulsion in question, λv very closely approaches the maximum absorption wavelength of the spectral sensitivity distribution. However, λv and the maximum absorption wavelength of the spectral sensitivity distribution do not always correspond to each other because of the adsorbed state of the spectral sensitizing dye and photon yield.

Further, when a dye is added to a lightsensitive emulsion layer for the adjustment of sensitivity and the prevention of irradiation, since the maximum absorption wavelength of the emulsion layer is caused by the absorption of the dye, λv and the maximum absorption wavelength of the spectral sensitivity distribution may not correspond to each other. However, since the dye diffuses into the whole photographic material during the period from the coating to the use of the photographic material, the absorption wavelength of the water-soluble dye does not correspond to λv referred to herein.

In the present invention, λv of the short-wavelength blue-sensitive emulsion layer can be determined by an equation (I) below:

$$\lambda v = \int_{400}^{500} \lambda \cdot Sv(\lambda)\, d\lambda \Big/ \int_{400}^{500} Sv(\lambda)\, d\lambda \qquad \text{(I)}$$

where Sv(λ) is the spectral sensitivity distribution the short-wavelength blue-sensitive emulsion layer at its color density of 0.5. However, when the short-wavelength blue-sensitive emulsion layer does not assume color, Sv(λ) can be determined from a result of the spectral response imparting the blackened silver concentration of 0.2 by silver-developing a sample on which a single layer is coated using the emulsion.

It is necessary that the weight-averaged wavelength λv of spectral sensitivity distribution of the short-wavelength blue-sensitive emulsion layer (VL layer) is 400 nm≦λv≦460 nm. 400 nm≦λv≦450 nm is preferable.

λv corresponds to the wavelength region called the negative spectral sensitivity in the spectral sensitivity which human eyes have, and plays an important role of bestowing the faithful color reproduction, which is the object of the present invention, by providing the inter-image effect from the VL layer to other color-sensitive layers.

As in usual red-, green- and blue-sensitive emulsion layers, the VL layer may contain a color-forming coupler, which can form a coloring dye by the reduction reaction of silver halide contained in the VL layer.

However, it is more preferable that the VL layer does not contain any color-forming coupler and thus does not exhibit color by the developing and coloring treatments (non-colored). It is preferable that the VL layer contains a non-color-forming coupler in order to prevent the dye formation at all. When the color formation is not provoked thus, the VL layer is a layer which exists only to impart the inter-image effect to other color-sensitive layers.

In the present invention, "substantially free of a yellow coupler" refers to a maximum yellow color density of the VL layer of 0.3 or less. In the present invention, a maximum yellow color density of the VL layer is preferably 0.2 or less.

The maximum yellow color density of the VL layer can be determined by measuring the image concentration of a sample that has been coated only with the VL layer and has been developed. It is also possible to specify the image density by calculation by determining the amount of color-forming coupler and the amount of silver halide contained in the VL layer.

Such a configuration is necessary for imparting the inter-image effect to other color-sensitive layers as mentioned above. Conventionally disclosed configurations are not those which introduce the layer which contains a silver halide emulsion having such λv. Accordingly, it could not have been anticipated from the conventionally disclosed techniques that the color reproduction is improved by providing the layer which contains silver halide having such λv.

The silver halide grains contained in the VL layer preferably contains silver iodide. The average silver iodide content of such grains is preferably 2 mol % or more and 39 mol % or less. It is more preferably 4 mol % or more and 39 mol % or less, and most preferably 6 mol % or more and 39 mol % or less.

It is preferable that the total silver iodide content of the silver halide grains contained in the VL layer is higher. In order to increase the total silver iodide content, it is preferable to make the VL layer a double layer, or to introduce a plurality of silver halide emulsions into a single VL layer. The total silver iodide content of the silver halide grains contained in the VL layer is preferably $1\times10^{-5}$ to $3\times10^{-3}$ mol/m$^2$. It is more preferably $3\times10^{-5}$ to $3\times10^{-3}$ mol/m$^2$, most preferably $5\times10^{-5}$ to $2\times10^{-3}$ mol/m$^2$. In the plurality of emulsions added, the equivalent-sphere average grain diameter in one emulsion and that in another emulsion are preferably different by 1.2 times or more mutually.

The equivalent-sphere average grain diameter refers to the volume-weighted average of the equivalent-sphere diameters of the grains contained. The equivalent-sphere diameter of a grain means a diameter of a sphere having the same volume as the grain.

The photographic material of the present invention has at least one blue-sensitive silver halide emulsion layer (BL layer), at least one green-sensitive silver halide emulsion layer (GL layer), at least one red-sensitive silver halide emulsion layer (RL layer) and at least one short-wavelength blue-sensitive emulsion layer (VL) on a support. The weight-averaged wavelength of spectral sensitivity distribution of the blue-sensitive silver halide emulsion layer (BL layer) is preferably longer than the weight-averaged wavelength (λv) of spectral sensitivity distribution of the short-wavelength blue-sensitive emulsion layer (VL layer). In the present invention, RL, GL and BL are preferably coated in this order from a side closer to the support. Further, each of the color-sensitive layers is preferably a unit configuration or structure that includes two or more lightsensitive emulsion layers having different sensitivities. In particular, each unit structure is a three-layer unit configuration consisting of a low sensitivity emulsion layer, an medium sensitivity emulsion layer and a high sensitivity emulsion layer, arranged in this order from a side closer to the support. These unit configurations are described in, for example, Jpn. Pat. Appln. KOKUKU Publication No. (hereinafter referred to as JP-B-) 49-15495, and JP-A-59-202464.

The VL layer can be arranged at 1) an intermediate position between the GL layer and the BL layer, or 2) a position which is farther from the support than the BL layer with respect to the above-mentioned RL, GL and BL layers. The VL layer is most preferably arranged at 1) an intermediate position between the GL layer and the BL layer.

Further, it is also preferable that an emulsion containing non-lightsensitive fine grains is present in the VL layer or its adjacent layer. The non-lightsensitive fine grains herein refer to silver halide grains having an equivalent-sphere diameter of 0.2 μm or less. The composition of the silver halide grains is not limited, but is preferably silver iodide, silver bromide or silver iodobromide, and may contain silver chloride so far as it can form mixed crystals.

The photographic material of the present invention preferably has, in addition to the green-sensitive silver halide emulsion layer noted above, at least one short-wavelength green-sensitive silver halide emulsion layer (CL layer) having a weight-averaged wavelength (λc) of spectral sensitivity distribution of 500 nm or more and 560 nm or less, and containing silver halide grains which can impart an inter-image effect by containing silver iodide. The silver halide grains in the CL layer are preferably those grains that contain 1 mol % or more of silver iodide, and more preferably 5 mol % or more of silver iodide.

The weight-averaged wavelength (λc) of spectral sensitivity distribution of the short-wavelength green-sensitive emulsion layer (CL layer) is intended to mean a weight-averaged wavelength of spectral sensitivity determined from the spectral sensitivity distribution Sc (λ). This can be determined by peeling every layer in the photographic material after coating, and measuring the spectral absorption property. In many cases, since it is caused by the absorption of J-associate of a spectral sensitizing dye in the emulsion in question, λv very closely approaches the maximum absorption wavelength of the spectral sensitivity distribution. However, λv and the maximum absorption wavelength of the spectral sensitivity distribution do not always correspond to each other because of the adsorbed state of the spectral sensitizing dye and photon yield.

Further, when a dye is added to a lightsensitive emulsion layer for the adjustment of sensitivity and the prevention of irradiation, since the maximum absorption wavelength of the emulsion layer is caused by the absorption of the dye, λc and the maximum absorption wavelength of the spectral sensitivity distribution may not correspond to each other. However, since the dye diffuses into the whole photographic material during the period from the coating to the use of the photographic material, the absorption wavelength of the water-soluble dye does not correspond to λc referred to herein.

In the present invention, λc of the short-wavelength green-sensitive emulsion layer can be determined by an equation (II) below:

$$\lambda c = \int_{400}^{700} \lambda \cdot Sc(\lambda)\, d\lambda \Big/ \int_{400}^{700} Sc(\lambda)\, d\lambda \qquad \text{(II)}$$

where Sc(λ) is the spectral sensitivity distribution of the short-wavelength green-sensitive emulsion layer at its color density of 0.5. However, when the short-wavelength green-sensitive emulsion layer does not assume color, Sc(λ) can be determined from a result of the spectral response imparting the blackened silver concentration of 0.2 by silver-developing a sample on which a single layer is coated using the emulsion.

It is necessary that the weight-averaged wavelength λc of spectral sensitivity distribution of the short-wavelength green-sensitive emulsion layer (CL layer) is 500 nm≦λc≦560 nm. 510 nm≦λc≦540 nm is preferable.

Further, it is also preferable that an emulsion containing non-lightsensitive fine grains is present in the CL layer or its adjacent layer. The non-lightsensitive fine grains herein refer to silver halide grains having an equivalent-sphere diameter of 0.2 μm or less. The composition of the silver halide grains is not limited, but is preferably silver iodide, silver bromide or silver iodobromide, and may contain silver chloride so far as it can form mixed crystals.

It is preferable that the CL layer does not form a magenta image substantially. The CL layer may contain a magenta coupler, but in this case, it is preferable that 1/5 mol % or less, more preferably 1/10 mol % or less of the total amount of the magenta couplers contained in the green-sensitive silver halide emulsion layers.

The CL layer can be arranged at any position, but is preferably arranged near the red-sensitive silver halide emulsion layer, and is more preferably arranged between the red-sensitive layer and the support.

Preferably, in the CL layer and/or in an interlayer separating the CL layer from the other layer, a competing compound, i.e., a compound that competes with an image-forming coupler to react with a color developing agent and does not form an image, is also added. Examples of the competing compound include reducing compounds such as hydroquinones, catechols, hydrazines and sulfonamidophenols; and compounds that couple with a color developing agent, but do not substantially form a color image (e.g., non-color-forming couplers as disclosed in German patent 1,155,675, British patent 861,138 and U.S. Pat. No. 3,876,428, and couplers that form dyes flowing out during processing processes. The amount of the competing compound is usually 0.01 g to 10 g, preferably 0.10 g to 5.0 g, per $m^2$ of photographic material.

As one of the preferable embodiments of the present invention, there can be mentioned a lightsensitive element having, coated on a support, an undercoat layer/an antihalation layer/a CL layer/a first intelayer/a RL layer unit (consisting of three layers of a low speed red-sensitive layer/a medium speed red-sensitive layer/a high speed red-sensitive layer from a side closer to the support)/a second interlayer/a GL layer unit (consisting of three layers of a low speed green-sensitive layer/an medium speed green-sensitive layer/a high speed green-sensitive layer from a side closer to the support)/a yellow filter layer/a VL layer/a third interlayer/a BL layer unit (consisting of three layers of a speed blue-sensitive layer/an medium speed blue-sensitive layer/a high speed blue-sensitive layer from a side closer to the support)/a first protective layer/a second protective layer/a third protective layer, in the order mentioned.

A layer containing non-lightsensitive fine grains may be provided adjacent to the VL layer.

Each of the first, second and third interlayers may be a single layer, or may be constructed into a configuration of 2 or more layers.

In the interlayers, a coupler or a DIR compound as described in JP-A's-61-43748, 59-113438, 59-113440, 61-20037 and 61-20038 may be contained, and a color ixing prevention agent may be contained, as is usually used.

Further, in the photographic material of the present invention, a non-coloring interlayer may be contained in the respective same color-sensitive lightsensitive units of the blue-sensitivity, green-sensitivity, red-sensitive and short-wavelength blue-sensitivity. A compound that can be selected as a competing compound described below is preferably contained in such an interlayer.

Further, the protective layer has preferably a three-layer structure of a first protective layer to a third protective layer. When the protective layer is in a two-layer or three-layer structure, silver halide fine grains having an equivalent-sphere average grain diameter of 0.10 μm or less is preferably contained in the second protective layer. The composition of the silver halide fine grains is preferably silver bromide or silver iodobromide.

The lightsensitive emulsion layers other than the VL layer mentioned herein means substantially the RL layer, the GL layer, the BL layer and the CL layer, mentioned above. The non-lightsensitive layer, having a color mixing prevention ability, which is arranged between these layers and the VL layer is a layer having an effect that the oxidized form of a developing agent generated in one side layer is prevented from transferring to the adjacent layer.

The layer having a color mixing prevention ability is preferably a gelatin layer, and/or a layer containing a competing compound, having a film thickness of 0.5 μm or more and 4 μm or less. The film thickness is more preferably 1 μm or more and 3 μm or less, and further preferably 1 μm or more and 2.5 μm or less.

The layer having a color mixing prevention ability preferably contains, as a competing compound, a compound which competes with an image-forming coupler to react with the oxidized form of a color developing agent and does not form a dye image, specifically, reducing compounds such as hydroquinones, cathecols, hydrazines, and sulfoneamidophenols, or compounds which are coupled with the oxidized form of a color developing agent but do not substantially form a color image (e.g., non color-forming couplers disclosed in DE 1,155,675, BG 861,138, U.S. Pat. Nos. 3,876,428, and 3,912,513, or a coupler producing a dye which flows out during a processing step, disclosed in JP-A-6-83002).

The more preferable competing compound is a hydroquinone compound or a hydrazine compound, and a hydroquinone compound is most preferable. Further, the most preferable hydroquinone compound is a monoalkylhydroquinone compound described in JP-A-10-026816.

Further, it is preferred that these competing compounds are contained, in the layer having a color mixing prevention ability, in an amount of 50 mg/m$^2$ or more and 1000 mg/m$^2$ or less, more preferably 150 mg/m$^2$ or more and 700 mg/m$^2$ or less, and most preferably 250 mg/m$^2$ or more and 500 mg/m$^2$ or less. Such a coated amount of these competing compounds is more than the amount used in a usual interlayer. It was unexpected that the use of the competing compound in this manner would be required for attaining the high fidelity of color reproduction.

Further, it is also preferable that the VL layer contains a cyan coupler. The preferable addition amount of cyan coupler is $1\times10^{-5}$ to $5\times10^{-1}$ mol, and preferably $5\times10^{-5}$ to $1\times10^{-1}$ mol per mole of silver halide in the VL layer. Usually, a coupler forming a color, which is in a complementary color relationship with light sensed by the emulsion, coexists. Accordingly, it is a usually unexpected technique that the short-wavelength blue-sensitive emulsion layer is cyan colored. An unexpected effect was obtained that the color discrimination from blue to purple colors is improved, and the color reproduction of other intermediate colors is also improved by this technique.

The photographic material of the present invention usually contains an image-forming coupler. The image-forming coupler means a coupler which couples with the oxidized form of an aromatic primary amine color developing agent to form an image-forming dye. Generally, a yellow coupler, a magenta coupler and a cyan coupler, which are image-forming couplers, are used in combination to form a color image.

The image-forming coupler used in the present invention is preferably added to a color-sensitive emulsion layer which is in a complementary color relationship with the color which the coupler forms. Namely, a yellow coupler is added to a blue-sensitive emulsion layer, a magenta coupler is added to a green-sensitive emulsion layer and a cyan coupler is added to a red-sensitive emulsion layer. Further, couplers which are not in such a complementary color relationship of may be additionally used in order to improve, e.g., a shadow imaging power (for example, a cyan coupler is additionally used in a green-sensitive emulsion layer).

The preferable image-forming coupler used in the photographic material of the present invention includes those shown below:

Yellow couplers:

couplers represented by formulas (I) and (II) in EP 502,424A;

couplers (for example, Y-28 on page 18) represented by formulas (1) and (2) in EP 513,496A;

couplers represented by formula (I) in claim 1 of EP 568,037A;

couplers represented by general formula (I) in column 1, lines 45 to 55 of U.S. Pat. No. 5,066,576;

couplers represented by general formula (I) in paragraph 0008 of JP-A-4-274425;

couplers (for example, D-35) defined in claim 1 on page 40 of EP 498,381A1;

couplers (for example, Y-1 and Y-54) represented by formula (Y) on page 4 of EP 447,969A1; and couplers represented by formulas (II) to (IV) in column 7, lines 36 to 58 of U.S. Pat. No. 4,476,219.

Magenta couplers:

couplers (for example, L-57, L-68 and L-77) described in JP-A-3-39737;

couplers (for example, A-4-63, A-4-73 and A-4-75) described in EP 456,257A;

couplers (for example, M-4, M-6 and M-7) described in EP 486,965A;

couplers (for example, M-45) described in EP 571,959A;

couplers (for example, M-1) described in JP-A-5-204106;

couplers (for example, M-22) described in JP-A-4-362631; and couplers (for example, CA-4, CA-7, CA-12, CA-15, CA-16 and CA-18) represented by general formula (MC-1) described in JP-A-11-119393.

Cyan couplers:

couplers (for example, CX-1, 3, 4, 5, 11, 12, 14 and 15) described in JP-A-4-204843;

couplers (for example, C-7, 10, 34, 35, and (I-1) and (I-17)) described in JP-A-4-43345;

couplers represented by general formulas (Ia) or (Ib) of claim 1 in JP-A-6-67385;

couplers (for example, CB-1, CB-4, CB-5, CB-9, CB-34, CB-44, CB-49 and CB-51) represented by general formula (PC-1) described in JP-A-11-119393; and couplers (for example, CC-1 and CC-17) represented by general formula (NC-1) described in JP-A-11-119393.

These couplers can be introduced into photographic material by various known dispersing methods. Preferably, an oil-in-water dispersing method is used, in which the couplers are dissolved in a high boiling organic solvent (if necessary, a low boiling solvent is additionally used), and the solution is emulsified and dispersed in an aqueous gelatin solution, which is then added to a silver halide emulsion.

Examples of the high-boiling solvent used in this oil-in-water dispersion method are described in, e.g., U.S. Pat. No. 2,322,027. Practical examples of steps, effects, and impregnating latexes of a latex dispersion method as one polymer dispersion method are described in, e.g., U.S. Pat. No. 4,199,363, West German Patent Application (OLS) Nos. 2,541,274 and 2,541,230, JP-B-53-41091, and EP029104. Dispersion using an organic solvent-soluble polymer is described in PCT International Publication WO88/00723.

Examples of the high-boiling solvent usable in the above-mentioned oil-in-water dispersion method are phthalic acid esters (e.g., dibutyl phthalate, dioctyl phthalate, dicyclohexyl phthalate, bis(2-ethylhexyl)phthalate, decyl phthalate, bis(2,4-di-tert-amylphenyl)isophthalate, and bis(1,1-diethylpropyl)phthalate), esters of phosphoric acid and phosphonic acid (e.g., diphenyl phosphate, triphenyl phosphate, tricresyl phosphate, 2-ethylhexyldiphenyl phosphate, dioctylbutyl phosphate, tricyclohexyl phosphate, tri-2-ethylhexyl phosphate, tridodecyl phosphate, and bis(2-ethylhexyl)phenylphosphate), benzoic acid esters (e.g., 2-ethylhexyl benzoate, 2,4-dichlorobenzoate, dodecyl benzoate, and 2-ethylhexyl-p-hydroxybenzoate), amides (e.g., N,N-diethyldodecaneamide, N,N-diethyllaurylamide, N,N,N,N-tetrakis(2-ethylhexyl)isophthalic acid amide), alcohols and phenols (e.g., isostearylalcohol and 2,4-di-tert-amylphenol), aliphatic esters (e.g., dibutoxyethyl succinate, bis(2-ethylhexyl) succinate, 2-hexyldecyl tetradecanoate, tributyl citrate, diethyl azelate, isostearyl lactate, and trioctyl tosylate), aniline derivatives (e.g., N,N-dibutyl-2-butoxy-5-tert-octylaniline), chlorinated paraffins (paraffins containing 10% to 80% of chlorine), trimesic acid esters (e.g., tributyl trimesate), dodecylbenzene, diisopropylnaphthalene, phenols (e.g., 2,4-di-tert-amylphenol, 4-dodecyloxyphenol, 4-dodecyloxycarbonylphenol, and 4-(4-dodecyloxyphenylsulfonyl)phenol), carboxylic acids (e.g., 2-(2,4-di-tert-amylphenoxybutyric acid and 2-ethoxyoctanedecanoic acid), and alkylphosphoric acids (e.g., bis(2-ethylhexyl)phosphoric acid and diphenylphosphoric acid). Further, compounds described in, e.g., JP-A-6-258803 can also be preferably used as high-boiling solvents.

The weight ratio of a high-boiling organic solvent to a coupler is preferably 0 to 2.0, more preferably, 0 to 1.0, and most preferably, 0 to 0.4.

An organic solvent having a boiling point of 30° C. to about 160° C., such as ethyl acetate, butyl acetate, ethyl propionate, methylethylketone, cyclohexanone, 2-ethoxyethylacetate, or dimethylformamide, may be additionally used as a co-solvent.

The content of each of yellow, magenta and cyan couplers in the photographic material is preferably 0.01 to 10 g, more preferably 0.1 to 2 g per $m^2$. A proper content of each of the couplers, per mol of silver halide contained in an emulsion layer(s) having sensitivity to the same color, is $1\times10^{-3}$ to 1 mol, and preferably $2\times10^{-3}$ to $3\times10^{-1}$ mol.

When the lightsensitive layer is composed of a unit structure having two or more lightsensitive emulsion layers different in speed, the content of the coupler is preferably $2\times10^{-3}$ to $2\times10^{-1}$ mol per mol of silver halide in a lowest sensitivity layer, and is preferably $3\times10^{-2}$ to $3\times10^{-1}$ mol per mol of silver halide in a highest sensitivity layer. It is preferred that a higher sensitivity layer contains a larger amount of coupler.

It is preferable that the photographic material contains a compound which can react with and fix a formaldehyde gas described in U.S. Pat. Nos. 4,411,987 and 4,435,503 in order to prevent the deterioration of photographic properties caused by the formaldehyde gas.

The emulsion used in the silver halide color photographic material of the invention preferably contains tabular silver halide grains having an aspect ratio of 1.5 or more and less than 100 or less (these grains are sometimes referred to as tabular grains). The tabular silver halide grains are the general name of silver halide grains having one twin crystal plane or two or more parallel crystal planes. The twin plane means a (111) face on the two sides of which ions at all lattice points have a mirror image relationship. The tabular grain is constituted by two opposing and parallel major surfaces and side faces linking these major surfaces. When the tabular grain is viewed in a direction perpendicular to the major surfaces, the major surface has a triangular, hexagonal or these rounded circular shapes. The triangular shape has the triangular opposing and parallel major surfaces, the hexagonal surface has the hexagonal opposing and parallel major surfaces, and the circular shape has the circular opposing and parallel major surfaces.

The aspect ratio of the tabular grain is a value obtained by dividing the grain diameter by the thickness. The measurement of thickness of the tabular grain can be easily carried out by depositing a metal from the oblique direction of the grain together with a latex for reference, measuring the length of its shadow on an electron microscope photograph and calculating referring to the length of shadow of the latex.

The grain diameter in the present invention is the diameter of a circle having an area equal to the projected area of the parallel major surfaces of the grain.

The projected area of the grain is obtained by measuring an area on the electron microscope photograph and compensating for a photographic magnification.

The diameter of the tabular grain is preferably 0.3 to 5.0 $\mu$m. The thickness of the tabular grain is preferably 0.05 to 0.5 $\mu$m.

In the tabular grains used in the present invention, the sum of their projected areas preferably occupies 50% or more, more preferably 80% or more of the sum of the projected areas of the total silver halide grains in the emulsion. Further, the aspect ratio of the tabular grains which occupy these areas is preferably 1.5 to less than 100, more preferably 2 to less than 20, and further preferably 2 to less than 8.

Further, when monodisperse tabular grains are used, a further preferable result may be obtained. The structure and production process of the monodisperse tabular grains follow those described in, e.g., JP-A-63-151618. Briefly, 70% or more of all the projected areas of silver halide grains are of a hexagonal shape in which the ratio of the length of a side having the maximum length to that of a side having the minimum length in the major surfaces is 2 or less, and are occupied by the tabular silver halide grains having two parallel planes as outer planes, with the hexagonal tabular grains having a monodispersity such that the variation coefficient of the grain diameter distribution [a value obtained by dividing the deviation (standard deviation) of grain diameters by the average grain diameter, multiplied by 100] is 20% or less.

The tabular grains used in the present invention preferably have dislocation lines.

The dislocation lines in the tabular grains can be observed by the direct method using a transmission electron microscope at low temperatures as described in, for example, J. F. Hamilton, Phot. Sci. Eng., 11, 57 (1967) and T. Shiozawa, J. Soc. Phot. Sci. Tech. Japan, 35, 213 (1972). More specifically, silver halide grains are harvested from the emulsion with the care that the grains are not pressurized with such a force that dislocations occur on the grains, are put on a mesh for electron microscope observation and, while cooling the specimen so as to prevent damaging (printout, etc.) by electron beams, are observed by the transmission method. The greater the thickness of the grains, the more difficult the transmission of electron beams. Therefore, the use of an electron microscope of high voltage type (at least 200 kV on the grains of 0.25 $\mu$m in thickness) is preferred for ensuring clearer observation. The thus obtained photograph of grains enables determining the position and number of dislocation lines in each grain viewed in the direction perpendicular to the main planes.

The position of the dislocation line of the tabular grains used in the present invention arises from x% of the distance between the center and the side to the side, along the long axis of the tabular grain. The value x is preferably $10 \leqq x < 100$, more preferably $30 \leqq x < 98$, and much more preferably $50 \leqq x < 95$. In this instance, the figure created by binding the positions from which the dislocation lines start is nearly similar to the configuration of the grain. The created figure may be one that is not a complete similar figure but deviated. The direction of the dislocation lines is roughly in the direction from the center to the sides, but they often wind.

Regarding the number of dislocation lines in the tabular grains used in the present invention, it is preferable that grains having 10 ore more dislocation lines are present in an amount of 50% (by number of grains) or more. More preferably, grains having 10 or more dislocation lines are present in an amount of 80% (by number of grains) or more, and especially preferably those having 20 or more dislocation lines in an amount of 80% (by number of grains) or more.

The preparation process of the tabular grain used in the present invention is described next.

The tabular grains used in the present invention can be prepared by improving methods described in, e.g., "Cleave, Photography Theory and Practice (1930), page 13", "Gutuff, Photographic Science and Engineering Vol. 14, pages 248–257 (1970)", U.S. Pat. Nos. 4,434,226, 4,414,310, 4,433,048 and 4,439,520, and GB 2,112,157.

Any of the silver halide compositions such as silver bromide, silver iodobromide, silver iodochlorobromide and silver chlorobromide may be used for the tabular silver halide grains used in the present invention. The preferable composition of silver halide grains is silver iodobromide or silver iodochlorobromide, containing 30 mol % or less of silver iodide.

The silver halide grains used in the present invention may have a multiple structure, for example, a quintuple structure, concerning the intra-grain silver halide composition. The structure here refers to a structure concerning the intra-grain silver iodide distribution, and it is indicated that the difference in silver iodide content between the structures is of 1 mol % or more. This intra-grain silver iodide distribution structure can be determined by calculations from the prescribed values in the grain preparation step. In the interface between layers of the structure, the silver iodide content may change either abruptly or moderately. The EPMA (Electron Probe Micro Analyzer) method is usually effective to confirm this structure, although the measurement accuracy of analysis must be taken into consideration. By preparing a sample in which emulsion grains are dispersed so as not to contact each other and analyzing the X-rays radiated upon radiating an electron beam, elements in a micro region irradiated with the electron beam can be analyzed. The measurement is preferably performed while cooling at low temperatures in order to prevent damage to the sample by the electron beam. By this method, the intra-grain silver iodide distribution of a tabular grain can be analyzed when the grain is viewed in a direction perpendicular to its main planes. Additionally, when a specimen obtained by hardening a sample and cutting the sample into ultra thin slices using microtome is used, the intra-grain silver iodide distribution in the section of a tabular grain can also be analyzed.

In the nucleation of the grain formation, it is very effective for the preparation of tabular grains to use a gelatin having a small methionine content disclosed in U.S. Pat. Nos. 4,713,320 and 4,942,120; to perform the nucleation at a high pBr disclosed in U.S. Pat. No. 4,914,014; and to perform the nucleation in a short time disclosed in JP-A-2-222940. Further, it may be effective in the ripening step to perform the ripening in the presence of a base of a low concentration disclosed in U.S. Pat. No. 5,254,453 and to perform the ripening at a high pH disclosed in U.S. Pat. No. 5,013,641.

The method of forming tabular grains using the polyalkyleneoxide compounds described in U.S. Pat. Nos. 5,147,771, 5,147,772, 5,147,773, 5,171,659, 5,210,013, and 5,252,453, is preferably used in the core grain preparation used in the present invention.

To obtain high-aspect-ratio monodisperse tabular grains, a gelatin is sometimes additionally added during the grain formation. The gelatin used is preferably a chemically modified gelatin described in JP-A's-10-148897 and 11-143002 or gelatin having a small methionine content described in U.S. Pat. Nos. 4,713,320 and 4,942,120. The former chemically modified gelatin is a gelatin characterized by at least two carboxyl groups newly introduced when the amino groups in the gelatin is chemically modified. It is preferable to use succinated gelatin or trimellitated gelatin. This chemically modified gelatin is added preferably before the growth step, and more preferably immediately after nucleation. The addition amount thereof is preferably 50% or more, more preferably 70% or more of the weight of the total dispersing medium used during the grain formation.

Examples of silver halide solvents which can be used in the present invention include (a) organic thioethers described in U.S. Pat. Nos. 3,271,157, 3,531,286 and 3,574,628, and JP-A's-54-1019 and 54-158917; (b) thiourea derivatives described in JP-A's-53-82408, 55-77737 and 55-2982; (c) silver halide solvents having a thiocarbonyl group interposed between an oxygen or sulfur atom and a nitrogen atom described in JP-A-53-144319; (d) imidazoles described in JP-A-54-100717; (e) sulfites; (f) ammonia; and (g) thiocyanates. Especially preferred silver halide solvents are thiocyanates, ammonia and tetramethylthiourea. Although the amount of silver halide solvent used depends on the type thereof, in the case of, for example, a thiocyanate, the preferred amount is in the range of $1\times10^{-4}$ to $1\times10^{-2}$ mol per mol of silver halide. Basically, when a washing step is provided after the first shell formation, the solvent can be removed regardless of the kind of a solvent used.

The dislocation of the tabular grain used in the present invention is introduced by providing a high-iodide phase to the inside of the grain.

The high-iodide phase is a silver halide solid solution containing iodine, and in this case, silver iodide, silver iodobromide and silver chloroiodobromide are preferable as the silver halide, silver iodide or silver iodobromide is preferable, and silver iodide is preferable in particular.

The amount of silver halide which forms the high-iodide phase, in terms of silver amount, is preferably 30 mol % or less, and more preferably 10 mol % or less of the total silver amount of the grain.

A phase grown at the outer side of the high-iodide phase is required to have a silver iodide content lower than that in the high-iodide phase, and its preferable silver iodide content is 0 to 12 mol %, further preferably 0 to 6 mol %, and most preferably 0 to 3 mol %.

As the preferable method of forming the high-iodide phase, there is a method wherein an emulsion containing silver iodobromide or silver iodide fine grains (hereinafter referred to also as silver iodide fine grain emulsion) is added to form the high-iodide phase. Fine grains preliminarily prepared can be used as these fine grains, and the fine grains immediately after preparation can be more preferably used.

A case of using the fine grains preliminarily prepared is firstly illustrated. In this case, there is a method wherein the fine grains preliminarily prepared are added, ripened and dissolved. As a more preferable method, there is a method wherein the silver iodide fine grain emulsion is added, and then an aqueous silver nitrate solution is added, or an aqueous silver nitrate solution and an aqueous halogen solution are added. In this case, the dissolution of the fine grains is accelerated by the addition of the aqueous silver nitrate solution. It is preferred that the silver iodide fine grain emulsion be added abruptly.

The abrupt addition of the silver iodide fine grain emulsion means that the silver iodide fine grain emulsion is added preferably within 10 minutes, more preferably within 7 minutes. The condition can be changed according to the temperature, pBr and pH of the system added, the kind and concentration of protective colloid agents such as a gelatin, and the presence or absence, kind, and concentration of the silver halide solvent, but the shorter period is preferable as described above. It is preferable that an aqueous solution of a silver salt such as silver nitrate should not be added at that addition. The temperature of the system at the addition is preferably 40° C. or more and 90° C. or less, and particularly preferably 50° C. or more and 80° C. or less in particular.

The composition of fine grains contained in the silver iodide fine grain emulsion may well be substantially silver iodide, may contain silver bromide and/or silver chloride so far as it can form mixed crystals. The composition is preferably 100% silver iodide. Silver iodide can take, in its crystal structure, a β-form, a γ-form, and an α-form or an α-form analogous structure as described in U.S. Pat. No. 4,672,026. In the present invention, although there is no limitation on the crystal structure in particular, a mixture of the β-form and the γ-form is preferably used, and the β-form is more preferably used. The silver iodide fine grain emulsion after the usual water washing step is preferably used. The silver iodide fine grain emulsion can be easily formed by a method described in U.S. Pat. No. 4,672,026. The double jet addition method wherein an aqueous silver salt solution and an aqueous iodide salt solution are added to form grains, with the pI value at the grain formation being kept constant. The pI is a logarithm of the reciprocal of $I^-$ ion concentration of the system. The temperature, pI, pH, the kind and concentration of protective colloid agents such as a gelatin, and the presence or absence, kind and concentration of the silver halide solvent are not limited in particular, but it is suitable for the present invention that the size of grains is 0.1 μm or less and more preferably 0.07 μm or less. Since the grains are fine grains, the grain shape is not perfectly specified, but the variation coefficient of the grain size distribution is preferably 25% or less. When it is 20% or less, the advantage of the invention is remarkable. The size and the size distribution of the fine grains are directly determined by putting the fine grains on a mesh for electron microscope observation, and observing, not by a carbon replica method, but by a permeation method. Since the grain size is small, measurement error becomes great by observation according to the carbon replica method. The grain size is defined as the diameter of a circle having a projected area equal to the grain observed. The size distribution of grains is also determined using the circle diameter having the equal projected area. The most effective fine grains in the present invention are those having a grain size of 0.06 μm or less and 0.02 μm or more, and a variation coefficient of a size distribution of grains of 18% or less.

In the formation of the silver iodide fine grain emulsion, after the above-mentioned grain formation, a usual washing with water described in U.S. Pat. No. 2,614,929 is preferably carried out on the silver iodide fine grain emulsion, and the adjustment of pH, pI, the concentration of protective colloid agents such as a gelatin and the concentration of the silver iodide contained is carried out. The pH value is preferably 5 or more and 7 or less. The pI is preferably set at a value in which the solubility of silver iodide is minimum, or at a value higher than that value. As the protective agent, a usual gelatin having an average molecular weight of about 100,000 is preferably used. A low-molecular-weight gelatin having an average molecular weight of 20,000 or less is also preferably used. Further, use of a mixture of the above-mentioned gelatins having different molecular weights may sometimes be advantageous. The amount of the gelatin per one kg of emulsion is preferably 10 g or more and 100 g or less, more preferably 20 g or more and 80 g or less. The amount of silver, in terms of silver atom, per one kg of emulsion is preferably 10 g or more and 100 g or less, more preferably 20 g or more and 80 g or less. The amount of the gelatin and/or the amount of silver is preferably selected so that the silver iodide fine grain emulsion can be abruptly added.

The silver iodide fine grain emulsion is usually dissolved before its addition, and the stirring efficiency of the system at the addition is required to be adequately enhanced. The rotational rate of stirring is preferably set higher than usual. The addition of a defoaming agent is effective for preventing the generation of foam upon stirring. Specifically, a defoaming agent described in, e.g., Examples of U.S. Pat. No. 5,275,929 can be used.

When the fine grains immediately after preparation is used, details concerning a mixer for forming the silver halide fine grains can be referred to in the description of JP-A-10-43570.

For the silver halide fine grains of the invention, it is preferable that the variation coefficient of the silver iodide content distribution between the grains is 20% or less, more preferably 15% or less, particularly preferably 10% or less. When the variation coefficient is more than 20%, it does not lead to a high contrast, and the sensitivity is largely decreased when a pressure is applied. The silver iodide content of each grain can be measured by analyzing the composition of each of grains using an X-ray micro analyzer. The variation coefficient of the silver iodide content distribution between the respective grains is a value determined by the equation (standard deviation/average silver iodide content)×100=variation coefficient, using the standard deviation of the silver iodide content and the average silver iodide content when the silver iodide content of at least 100 or more, more preferably 200 or more and particularly preferably 300 or more of the emulsion grains is measured. The measurement of the silver iodide content of each grain is described in, for example, EP 147,868. There is a correlation or no correlation between the silver iodide content Yi (mol %) of the individual grains and the equivalent-sphere diameter Xi (μm) of the respective grains, but no correlation is desirable.

The silver halide emulsion of the invention is preferably provided with a positive hole-capturing zone in at least a portion of the inside of the silver halide grains. The positive hole-capturing zone of the invention indicates a region having a function of capturing a positive hole generated in a pair with photo-electron generated by, for example, photo-excitation. Such a positive hole-capturing zone is defined in the present invention as a zone provided by an intentional reduction sensitization.

The intentional reduction sensitization in the present invention means an operation of introducing a positive hole-capturing silver nuclei into a portion or all of the inside of the silver halide grains by adding a reduction sensitizing agent. The positive hole-capturing silver nuclei means a small silver nuclei having a little development activity, and the recombination loss in a photosensitization process is prevented by the silver nuclei and the sensitivity can be enhanced.

Examples of reduction sensitizers include stannous salts, ascorbic acid and derivatives thereof, amines and polyamines, hydrazine derivatives, formamidinesulfinic acid, silane compounds and borane compounds, which are known per se. In the reduction sensitization employed in the present invention, these known reduction sensitizers may be used singly or in combination. Preferred reduction sensitizers are stannous chloride, thiourea dioxide, dimethylaminoborane, ascorbic acid and derivatives thereof. The addition amount of reduction sensitizer must be selected depending on the emulsion manufacturing conditions, and it is preferred that the addition amount range from $10^{-7}$ to $10^{-3}$ mol per mol of silver halide.

The reduction sensitizer is dissolved in water or any of organic solvents such as alcohols, glycols, ketones, esters and amides, and added during the grain growth.

In the present invention, the positive hole-capturing silver nuclei is preferably formed by adding a reduction sensitizer after the completion the nucleation and the physical ripening and immediately before the initiation of grain formation. However, the positive hole-capturing silver nuclei can also be introduced on the grain surface by adding a reduction sensitizer on and after the completion of the grain formation.

When a reduction sensitizer is added during grain formation, some silver nuclei formed can stay inside the grain, but some ooze out to form silver nuclei on the grain surface. In the present invention, these oozing silver nuclei can also be utilized as positive hole-capturing silver nuclei.

In the present invention, the intentional reduction sensitization performed during a step in the midst of the grain growth to form the positive hole-capturing nuclei inside the silver halide grain is preferably carried out in the presence of a compound represented by general formula (I-1) or general formula (I-2) described below.

It should be noted that the step in the midst of the grain growth does not include the step after the final desalting is performed. For example, a step of chemical sensitization in which silver halide grains grow as a result of the addition of a silver salt solution and fine grain silver halide, is not included.

(I-1)

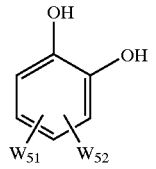

(I-2)

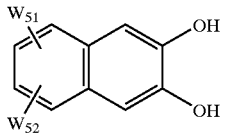

In formulas (I-1) and (I-2), each of $W_{51}$ and $W_{52}$ independently represents a sulfo group or a hydrogen atom, and at least one of $W_{51}$ and $W_{52}$ represents a sulfo group. A sulfo group is generally in the form of a water-soluble salt, e.g., an alkali metal salt such as sodium or potassium, or an ammonium salt. Favorable practical examples are 3,5-disulfocatechol disodium salt, 4-sulfocatechol ammonium salt, 2,3-dihydroxy-7-sulfonaphthalene sodium salt, and 2,3-dihydroxy-6,7-disulfonaphthalen potassium salt. A preferred addition amount of the above compound can vary depending on, e.g., the temperature, pBr, and pH of the system to which the compound is added, the type and concentration of a protective colloid agent such as gelatin, and the presence/absence, type and concentration of a silver halide solvent. Generally, the addition amount of the compound is preferably 0.0005 to 0.5 mol, and more preferably, 0.003 to 0.02 mol per mol of silver halide.

An oxidizer capable of oxidizing silver is preferably used during the process of producing the silver halide emulsion for use in the present invention The silver oxidizer is a compound having an effect of acting on metallic silver to convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt readily soluble in water, such as silver nitrate. The silver oxidizer may be either an inorganic or an organic substance. Examples of suitable inorganic oxidizers include ozone, hydrogen peroxide and its adducts (e.g., $NaBO_2.H_2O_2.3H_2O$, $2NaCO_3.3H_2O_2$, $Na_4P_2O_7.2H_2O_2$ and $2Na_2SO_4.H_2O_2.2H_2O$), peroxy acid salts (e.g., $K_2S_2O_8$, $K_2C_2O_6$ and $K_2P_2O_8$), peroxy complex compounds (e.g., $K_2[Ti(O_2)C_2O_4].3H_2O$, $4K_2SO_4.Ti(O_2)OH.SO_4.2H_2O$ and $Na_3[VO(O_2)(C_2H_4)_2].6H_2O$), oxo-acid salts such as permanganates (e.g., $KMnO_4$) and chromates (e.g., $K_2Cr_2O_7$), halogen elements such as iodine and bromine, perhalogenates (e.g., potassium periodate), salts of high-valence metals (e.g., potassium hexacyanoferrate (II)) and thiosulfonates.

Examples of organic oxidizers include quinones such as p-quinone, organic peroxides such as peracetic acid and perbenzoic acid, and active halogen-releasing compounds (e.g., N-bromosuccinimide, chloramine T and chloramine B).

Oxidizers preferred in the present invention are ozone, hydrogen peroxide and its adducts, halogen elements and thiosulfonates, as inorganic oxidizers, and quinines as organic oxidizers. Especially preferred are thiosulfonates such as those described in JP-A-2-191938.

The addition of the oxidizer to silver may be performed either before the initiation of the intentional reduction sensitization, or during reduction sensitization, or immediately before the termination of reduction sensitization, or immediately after the termination of reduction sensitization. The addition of the oxidizer to silver may be performed several times separately. The addition amount varies depending on the kind of the oxidizer, it is preferably in the range of $1\times10^{-7}$ to $1\times10^{-3}$ mol per mol of silver halide.

It is advantageous to use a gelatin as a protective colloid for use in preparation of emulsions of the invention or as a binder for other hydrophilic colloid layers. However, another hydrophilic colloid can also be used in place of gelatin.

Examples of the hydrophilic colloid are protein, such as a gelatin derivative, a graft polymer of gelatin and another high polymer, albumin, and casein; sugar derivatives, such as cellulose derivatives, e.g., cellulose sulfates, hydroxyethylcellulose, and carboxymethylcellulose, sodium alginate, and starch derivatives; and a variety of synthetic hydrophilic high polymers, such as homopolymers or copolymers, e.g., polyvinyl alcohol, partial acetal of polyvinyl alcohol, poly-N-vinylpyrrolidone, polyacrylic acid, polymethacrylic acid, polyacrylamide, polyvinylimidazole, and polyvinylpyrazole.

Examples of gelatin are lime-processed gelatin, acid-processed gelatin, and enzyme-processed gelatin described in Bull. Soc. Sci. Photo. Japan, 16, 30 (1966). A hydrolyzed product or an enzyme-decomposed product of gelatin can also be used.

It is preferable to water wash an emulsion of the present invention to desalt, and disperse into a newly prepared protective colloid. Although the temperature at the water washing can be selected in accordance with the intended use, it is preferably 5° C. to 50° C. Although the pH at the water washing can also be selected in accordance with the intended use, it is preferably 2 to 10, and more preferably, 3 to 8. The pAg at the water washing is preferably 5 to 10, though it can be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

In the preparation of the emulsion used in the invention, it is preferable to make salt of metal ion exist, for example, during grain formation, desalting, or chemical sensitization, or before coating in accordance with the intended use. The metal ion salt is preferably added during grain formation when doped into grains, and after grain formation and before completion of chemical sensitization when used to decorate the grain surface or used as a chemical sensitizer. The salt can be doped in any of an overall grain, only the core or only the shell. Examples of the dopant metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroxide, 6-coordinated complex salt or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_4[Fe(CN)_6]$, $K_2IrCl_6$, $K_3IrCl_6$, $(NH_4)_3RhCl_6$, and $K_4Ru(CN)_6$. The ligand of a coordination compound can be selected from halo, aqua, cyano, cyanate, thiocyanate, nitrosyl, thionitrosyl, oxo, and carbonyl. These metal compounds can be used either singly or in combination of two or more of them.

The metal compounds are preferably dissolved in water or in an appropriate organic solvent, such as methanol or acetone, before addition. To stabilize the solution, an aqueous hydrogen halogenide solution (e.g., HCl or HBr) or an alkali halide (e.g., KCl, NaCl, KBr, or NaBr) can be added. It is also possible to add an acid or an alkali, if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, or KI) and the resultant solution may be added continuously during formation of silver halide grains. Furthermore, a solution of the metal compounds can be prepared independently of a water-soluble salt or an alkali halide, and added continuously at a proper timing during grain formation. It is also possible to combine several different addition methods.

It is sometimes useful to add a chalcogen compound during preparation of an emulsion, described in U.S. Pat. No. 3,772,031. Instead of S, Se, and Te, cyanate, thiocyanate, selenocyanic acid, carbonate, phosphate, and acetate can be present.

In the silver halide grains used in the invention, at least one of chalcogen sensitization including sulfur sensitization and selenium sensitization, and noble metal sensitization including gold sensitization and palladium sensitization, and reduction sensitization can be performed at any point during the process of preparing a silver halide emulsion. The use of two or more different sensitizing methods is preferable.

Several different types of emulsions can be prepared by changing the timing at which the chemical sensitization is performed. The emulsion types are classified into: a type in which a chemical sensitization nucleus is embedded inside the grain, a type in which it is embedded in a shallow position from the surface of the grain, and a type in which it is formed on the surface of the grain. In the emulsions used in the present invention, the position of a chemical sensitization nucleus can be selected in accordance with the intended use.

One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, Apr., 1974, 12008, Research Disclosure, Vol. 34, Jun., 1975, 13452, U.S. Pat. Nos. 2,642,361, 3,297,446, 3,772,031, 3,857,711, 3,901,714, 4,266,018, and 3,904,415, and British Patent 1,315,755.

In the noble metal sensitization, salts of noble metals, such as gold, platinum, palladium, and iridium, can be used. In particular, gold sensitization, palladium sensitization, or a combination of the both is preferred. In the gold sensitization, it is possible to use known compounds, such as chloroauric acid, potassium chloroaurate, potassium aurithiocyanate, gold sulfide, and gold selenide, or mesoionic gold compounds described in U.S. Pat. No. 5,220,030 and azole gold compounds described in U.S. Pat. No. 5,049,484 and so on. A palladium compound means a divalent or tetravalent salt of palladium. A preferable palladium compound is represented by $R_2PdX_6$ or $R_2PdX_4$ where R represents a hydrogen atom, an alkali metal atom or an ammonium group, and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

A preferable amount of a gold sensitizer used in the invention is $1\times10^{-3}$ to $1\times10^{-7}$ mol, and more preferably, $1\times10^{-4}$ to $5\times10^{-7}$ mol per mol of silver halide. A preferable amount of a palladium compound is $1\times10^{-3}$ to $5\times10^{-7}$ mol per mol of silver halide. A preferable amount of a thiocyan compound or a selenocyan compound is $5\times10^{-2}$ to $1\times10^{-6}$ mol per mol of silver halide.

Examples of a sulfur sensitizer are hypo, a thiourea-based compound, a rhodanine-based compound, and sulfur-containing compounds described in U.S. Pat. Nos. 3,857, 711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid/modifier are described in U.S. Pat. Nos. 2,131,038, 3,411,914, and 3,554,757, JP-A-58-126526, and G. F. Duffin, Photographic Emulsion Chemistry, pages 138 to 143.

A preferable amount of a sulfur sensitizer used in the invention is $1\times10^{-4}$ to $1\times10^{-7}$ mol, and more preferably, $1\times10^{-5}$ to $5\times10^{-7}$ mol per mol of silver halide.

As a preferable sensitizing method for the emulsion used the invention, selenium sensitization can be mentioned. As a selenium sensitizer used in the invention, selenium compounds disclosed in hitherto published patents can be used. In the use of labile selenium compound and/or non-labile selenium compound, generally, it is added to an emulsion and the emulsion is agitated at high temperature, preferably 40° C. or above, for a given period of time. Compounds described in, for example, JP-B-44-15748, JP-B-43-13489, JP-A's-4-25832 and 4-109240 are preferably used as the non-labile selenium compound.

Specific examples of the labile selenium sensitizers include isoselenocyanates (e.g., aliphatic isoselenocyanates such as allyl isoselenocyanate), selenoureas, selenoketones, selenoamides, selenocarboxylic acids (e.g., 2-selenopropionic acid and 2-selenobutyric acid), selenoesters, diacyl selenides (e.g., bis(3-chloro-2,6-dimethoxybenzoyl)selenide), selenophosphates, phosphine selenides and colloidal metal selenium.

The labile selenium compounds, although preferred types thereof are as mentioned above, are not limited thereto. It is generally understood by persons of ordinary skill in the art to which the invention pertains that the structure of the labile selenium compound as a photographic emulsion sensitizer is not so important as long as the selenium is labile and that the labile selenium compound plays no other role than having its selenium carried by organic portions of selenium sensitizer molecules and causing it to present in the labile form in the emulsion. In the present invention, the labile selenium compounds of this broad concept can be used advantageously.

Compounds described in JP-B's-46-4553, 52-34492 and 52-34491 can be used as the non-labile selenium compound used in the present invention. Examples of the non-labile selenium compounds include selenious acid, potassium selenocyanate, selenazoles, quaternary selenazole salts, diaryl selenides, diaryl diselenides, dialkyl selenides, dialkyl diselenides, 2-selenazolidinedione, 2-selenoxazolidinethione and derivatives thereof.

These selenium sensitizers are dissolved in water, or an organic solvent such as methanol or ethanol, or a mixture thereof, and added at the time of chemical sensitization. Preferably, the addition is performed prior to the initiation of chemical sensitization. The selenium sensitizers can be used singly or in combination. The combined use of a labile selenium compound and an non-labile selenium compound is preferred.

The addition amount of the selenium sensitizer for use in the invention can vary depending on, e.g., the activity of a selenium sensitizer used, the type and size of silver halide, and the ripening temperature and time, and is preferably in the range of $1\times10^{-8}$ or more per mol of silver halide. More preferably, the amount is $1\times10^{-7}$ mol or more and $5\times10^{-5}$ mol or less per mol of silver halide. The temperature of chemical ripening in the case of using a selenium sensitizer is preferably 40° C. or more and 80° C. or less. The pAg and pH are arbitrary. For example, with respect to pH, the effect of the present invention can be exerted even if it widely ranges from 4 to 9.

Selenium sensitization is preferably used in combination with sulfur sensitization or noble metal sensitization or both of them. Further, in the present invention, a thiocyanic acid salt is preferably added to the silver halide emulsion at the time of chemical sensitization. The thiocyanate that can be used include potassium thiocyanate, sodium thiocyanate, and ammonium thiocyanate. It is usually dissolved in an aqueous solution or a water-soluble solvent before it is added. The addition amount thereof is $1\times10^{-5}$ mol to $1\times10^{-2}$ mol, and more preferably $5\times10^{-5}$ mol to $5\times10^{-3}$ mol, per mol of silver halide.

It is preferred that the silver halide emulsion used in the present invention contains an appropriate amount of calcium ions and/or magnesium ions. Thereby, the graininess, the quality of an image, and the preservation properties are all improved. The appropriate amount noted above is 400 to 2500 ppm for calcium and/or 50 to 2500 ppm for magnesium, and calcium is more preferably 500 to 2000 ppm and magnesium is more preferably 200 to 2000 ppm. It should be noted that 400 to 2500 ppm for calcium and/or 50 to 2500 ppm for magnesium means that at least one of calcium and magnesium is at a concentration within the range mentioned above. When the content of calcium or magnesium is higher than the above range, the calcium salt, magnesium salt, and the organic salt which the gelatin has tend to precipitate, causing a trouble during manufacture of the photographic material. It should be noted that the content of calcium or magnesium corresponds to the weight in terms of calcium or magnesium atom for all calcium- or magnesium-containing containing compounds such as calcium ions, magnesium ions, a calcium salt and a magnesium salt, and expressed in concentration per unit weight emulsion.

The adjustment of the calcium content in the silver halide tabular emulsion used in the invention is preferably carried out by adding a calcium salt at the time of chemical sensitization. The gelatin generally used for manufacturing an emulsion already contains 100 to 4000 ppm of calcium as a solid gelatin, but the amount of calcium may be increased by adding a calcium salt to the gelatin. Further, if necessary, after carrying out the desalting (removal of calcium) from the gelatin according to a known method such as a water washing or an ion exchange method, the content can be adjusted by the addition of a calcium salt. Preferable calcium salts are calcium nitrate and calcium chloride with calcium nitrate being most preferable. Similarly, the adjustment of the magnesium content can be carried out by adding a magnesium salt. Preferable magnesium salts are magnesium nitrate, magnesium sulfate and magnesium chloride, with magnesium nitrate being most preferable. For the quantitative determination of calcium or magnesium, an ICP emission spectral analysis method may be used. Calcium and magnesium may be used singly or in combination. It is more preferable that calcium be used. The addition of calcium or magnesium can be carried out at the arbitrary period during manufacture of the silver halide emulsion, but is preferably carried out at the period of after the grain formation and immediately after completion of the spectral sensitization and chemical sensitization, and more preferably carried out after addition of a sensitizing dye. Further, it is most preferably carried out after the addition of a sensitizing dye and before carrying out the chemical sensitization.

As a particularly effective compound for reducing the fog of the silver halide emulsion and suppressing the increase of the fog during preservation, a mercaptotetrazol compound having a water-soluble group described in JP-A-4-16838 is mentioned. Further, in the JP-A document, it is disclosed that the preservation property is enhanced by using the mercaptotetrazol compound and a mercaptothiadiazol compound in combination.

The surface or an arbitrary position from the surface of the grain contained in the emulsion used in the present invention may be chemically sensitized, but it is preferable to chemically sensitize the surface. When the inside portion of the grain is chemically sensitized, a method described in JP-A-63-264740 can be referred to.

Photographic emulsions used in the present invention can contain various compounds in order to prevent fog during the preparing process, storage, or photographic processing of the sensitized material, or to stabilize photographic properties. That is, it is possible to add many compounds known as antifoggants or stabilizers, e.g., thiazoles such as benzothiazolium salt; nitroimidazoles; nitrobenzimidazoles; chlorobenzimidazoles; bromobenzimidazoles; mercaptothiazoles; mercaptobenzothiazoles; mercaptobenzimidazoles; mercaptothiadiazoles; aminotriazoles; benzotriazoles; nitrobenzotriazoles; mercaptotetrazoles (particularly 1-phenyl-5-mercaptotetrazole); mercaptopyrimidines; mercaptotriazines; thioketo compounds such as oxazolinethione; azaindenes such as triazaindenes, tetrazaindenes (particularly 4-hydroxy-substituted(1,3,3a,7) tetrazaindenes), and pentazaindenes. For example, compounds described in U.S. Pat. Nos. 3,954,474 and 3,982,947 and JP-B-52-28660 can be used. One preferred compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and stabilizers are added during preparation of an emulsion to achieve their inherent fog preventing effect and stabilizing effect. In addition, the antifoggants and stabilizers can be used for various purposes of, e.g., controlling the crystal habit of grains, decreasing the grain size, decreasing the solubility of grains, controlling chemical sensitization, and controlling the arrangement of dyes.

The photographic emulsion for use in the present invention is preferably subjected to a spectral sensitization with a methine dye or the like to exert the effects of the invention. Examples of dyes used include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. These dyes may contain any of nuclei commonly used in cyanine dyes as basic heterocyclic nuclei. Examples of such nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have substituents on carbon atoms thereof.

The merocyanine dye or composite merocyanine dye may have a 5 or 6-membered heterocyclic nucleus such as a pyrazolin-5-one nucleus, a thiohydantoin nucleus, a 2-thioxazolidine-2,4-dione nucleus, a thiazolidine-2,4-dione nucleus, a rhodanine nucleus or a thiobarbituric acid nucleus as a nucleus having a ketomethylene structure.

These spectral sensitizing dyes may be used either singly or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, and 3,837,862, 4,026,707, GB Nos. 1,344,281 and 1,507,803, JP-B's-43-4936 and 53-12375, and JP-A's-52-110618 and 52-109925.

The emulsion used in the present invention may contain a dye which itself exerts no spectral sensitizing effect or a substance which absorbs substantially none of visible radiation and exhibits supersensitization, together with the above spectral sensitizing dye.

The spectral sensitizing dye may be added to the emulsion at any stage of the process for preparing the emulsion, which is known as being useful. Although the addition is most usually conducted at a stage between the completion of the chemical sensitization and the coating, the spectral sensitizing dye can be added simultaneously with the chemical sensitizer to simultaneously effect the spectral sensitization and the chemical sensitization as described in U.S. Pat. Nos. 3,628,969 and 4,225,666. Alternatively, the spectral sensitizing dye can be added prior to the chemical sensitization or the spectral sensitizing dye can be added prior to the completion of silver halide grain precipitation to initiate the spectral sensitization as described in JP-A-58-113928. Further, the sensitizing dye can be added portionwise, that is, a part of the sensitizing dye can be added prior to the chemical sensitization with the rest of the sensitizing dye added after the chemical sensitization as taught in U.S. Pat. No. 4,225,666. Still further, the spectral sensitizing dye can be added at any stage during the formation of silver halide grains according to the method disclosed in U.S. Pat. No. 4,183,756 and other methods. The spectral sensitizing dye can be used in an amount of $4\times10^{-6}$ to $8\times10^{-3}$ mol per mol of silver halide.

The silver halide grains other than the tabular grains used in the photographic material of the present invention will be described below.

A preferable silver halide contained in the photographic emulsion layer used in the photographic material of the present invention is silver iodobromide, silver iodochloride or silver iodochlorobromide, containing about 30 mol % or less of silver iodide. Silver iodobromide or silver iodochlorobromide, containing about 0.5 mol % to about 10 mol % of silver iodide, is particularly preferable.

The silver halide grains in the photographic emulsion may be those having a regular crystal such as a cubic, octahedral or tetradecahedral crystal; those having a regular crystal shape such as spherical or tabular; those having crystal defects such as twin planes, or a composite from thereof.

The silver halide grains may consist of fine grains having a grain size of about 0.2 $\mu$m or less, and may consist of a large sized grains having a projected area diameter up to about 10 $\mu$m. The emulsion containing these grains may be a polydisperse emulsion or a monodisperse emulsion.

The silver halide photographic emulsion which can be used in the present invention can be prepared by, for example, "Research Disclosure (RD) No. 17643 (December in 1978), page 22 to 23", "I. Emulsion Preparation and types", "ibid., No. 18716 (November in 1979), page 648", "ibid., No. 307105 (November in 1989), page 863 to 865", "Chemie et Phisique Photographique" authored by P. Glafkides and published by Paul Montel Co., Ltd. (1967), "Photographic Emulsion Chemistry" authored by G. F. Duffin and published by Forcal Press Co., Ltd. (1966), and "Making and Coating Photographic Emulsion" authored by V. L. Zelikman et al and published by Forcal Press Co., Ltd.

Monodisperse emulsions described in U.S. Pat. Nos. 3,574,628 and 3,655,394, and GB 1,413,748 are also preferable.

The crystal structure may be uniform in the silver halide composition, or may be different in the silver halide composition at the inner portion and the outer portion, or may be a layered structure. Further, the grains may be joined with silver halide having a different composition by an epitaxial junction, or may be joined with a compound such as silver rhodanide or lead oxide other than silver halide. Further, a mixture of grains having various crystal shapes may be used.

The above-mentioned emulsion may be any one of a surface latent image type in which a latent image is mainly formed on the surface, an internal latent image type in which a latent image is formed in the inside of grains, and a type in which latent images are formed both on the surface and in the inside, but should be a negative emulsion. Among the internal latent image types, a core/shell internal latent image type emulsion described in JP-A-63-264740 may be used. The method of preparing the core/shell internal latent image type emulsion is described in JP-A-59-133542. The thickness of the shell the grains can vary depending on, e.g., development treatment, but is preferably 3 to 40 nm, and more preferably 5 to 20 nm.

It is preferable to use surface-fogged silver halide grains as described in U.S. Pat. No. 4,082,553, internally fogged silver halide grains described in U.S. Pat. No. 4,626,498 and JP-A-59-214852, or colloidal silver, in the lightsensitive silver halide emulsion layers and/or essentially non-lightsensitive hydrophilic colloid layers. The internally fogged or surface-fogged silver halide grains means silver halide grains which can be developed uniformly (non-imagewise) regardless of whether the location is a non-exposed or an exposed portion of the photographic material. A method of preparing the internally fogged or surface-fogged silver halide grains is described in U.S. Pat. No. 4,626,498 and JP-A-59-214852.

A silver halide which forms the core of an internally fogged core/shell type silver halide grain can have the same halogen composition or a different halogen composition. As the silver halide composition of the internally fogged or surface-fogged silver halide grains, any of silver chloride, silver chlorobromide, silver iodobromide and silver chloroiodobromide can be used. Although the grain size of these fogged silver halide grains is not particularly limited, the equivalent-sphere diameter thereof is preferably 0.01 to 0.75 $\mu$m, and especially preferably 0.05 to 0.6 $\mu$m. Further, the grains is not particularly limited on the shape, but can be regular in shape, or may be polydisperse grains. However, the gains are preferably monodisperse, i.e., at least 95% in weight or number of silver halide grains have an equivalent-sphere diameter falling within the range of ±40% of the equivalent-sphere average grain diameter).

In the photographic material of the present invention, two or more lightsensitive emulsions differing in at least one property of the grain size, grain size distribution, halogen composition, grain shape and sensitivity can be used in the same layer.

In the preparation of the photographic material used in the invention, a photographically useful substance is usually added to a photographic coating solution, i.e., a hydrophilic colloidal solution.

In the silver halide photosensitive emulsion used in the invention and the silver halide photographic material using such an emulsion, it is generally possible to use various techniques and inorganic and organic materials described in Research Disclosure Nos. 308119 (1989), 37038 (1995), and 40145 (1997).

In addition, techniques and inorganic and organic materials usable in color photosensitive materials of the present invention are described in EP4 36,938A2 and patents cited below.

| | Items | Corresponding portions |
|---|---|---|
| 1) | Layer configurations | page 146, line 34 to page 147, line 25 |
| 2) | Silver halide emulsions usable together | page 147, line 26 to page 148 line 12 |
| 3) | Yellow couplers usable together | page 137, line 35 to page 146, line 33, and page 149, lines 21 to 23 |
| 4) | Magenta couplers usable together | page 149, lines 24 to 28; EP421, 453A1, page 3, line 5 to page 25, line 55 |
| 5) | Cyan couplers usable together | page 149, lines 29 to 33; EP432, 804A2, page 3, line 28 to page 40, line 2 |
| 6) | Polymer couplers | page 149, lines 34 to 38; EP435, 334A2, page 113, line 39 to page 123, line 37 |
| 7) | Colored couplers | page 53, line 42 to page 137, line 34, and page 149, lines 39 to 45 |
| 8) | Functional couplers usable together | page 7, line 1 to page 53, line 41, and page 149, line 46 to page 150, line 3; EP435, 334A2, page 3, line 1 to page 29, line 50 |
| 9) | Antiseptic and mildewproofing agents | page 150, lines 25 to 28 |
| 10) | Formalin scavengers | page 149, lines 15 to 17 |
| 11) | Other additives usable together | page 153, lines 38 to 47; EP421, 453A1, page 75, line 21 to page 84, line 56, and page 27, line 40 to page 37, line 40 |
| 12) | Dispersion methods | page 150, lines 4 to 24 |
| 13) | Supports | page 150, lines 32 to 34 |
| 14) | Film thickness film physical properties | page 150, lines 35 to 49 |
| 15) | Color development step | page 150, line 50 to page 151, line 47 |
| 16) | Desilvering step | page 151, line 48 to page 152, line 53 |
| 17) | Automatic processor | page 152, line 54 to page 153, line 2 |
| 18) | Washing/stabilizing step | page 153, lines 3 to 37 |

The photographic material of the present invention is usually processed with an alkali developer liquid containing a developing agent after imagewise exposure. The photographic material after the color development is processed with a processing liquid which contains a bleaching agent and thus has a bleaching ability to form an image.

The present invention is specifically illustrated below by way of Examples, but should not be limited to these Examples.

EXAMPLE 1

<Gelatin used in the Preparation of Silver Halide Emulsions and Method of Preparing the Same>

| | |
|---|---|
| Gelatin-1: | Conventional alkali-processed ossein gelatin made from cattle bones. No —$NH_2$ groups in the gelatin were chemically modified. |
| Gelatin-2: | Gelatin formed by adding succinic anhydride to an aqueous solution of gelatin-1 at 50° C. and pH 9.0 to cause chemical reaction, removing the residual succinic acid, and drying the resultant material. The ratio of the number of chemically modified —$NH_2$ groups in the gelatin was 95%. |
| Gelatin-3: | Gelatin formed by decreasing the molecular weight of gelatin-1 by allowing enzyme to act on it to an average molecular weight of 15,000, deactivating the enzyme, and and drying the resultant material. No —$NH_2$ groups in the gelatin were chemically modified. |

All of gelatin-1 to gelatin-3 were deionized and so adjusted that the pH of the aqueous 5% solution at 35° C. was 6.0.

<Preparation Method of Emulsion VL-1>

Preparation of Core 1200 mililiter (mL) of an aqueous solution containing 0.8 g of KBr and 1.0 g of the gelatin-3 was stirred while keeping at 35° C. (1st solution preparation). 40 mL of an aqueous solution Ag-1 (containing 10.2 g of $AgNO_3$ in 100 mL), 30 mL of an aqueous solution X-1 (containing 9.5 g of KBr in 100 mL), and 30 mL of an aqueous solution G-1 (containing 6.6 g of a low-molecular-weight gelatin having the same molecular weight of 15000 as that used in the 1st solution preparation, in 100 mL) were added over 30 seconds at a constant flow rate by the triple jet method (addition 1). Thereafter, 1.4 g of KBr was added and the temperature was raised to 65° C. so that the ripening was performed. Just before completion of the ripening, 300 mL of an aqueous solution G-2 (containing 11.0 g of the gelatin-2 in 100 mL) was added.

Then, 480 mL of an aqueous solution Ag-2 (containing 30.0 g of $AgNO_3$ in 100 mL) and an aqueous solution X-2 (containing 30.0 g of KBr in 100 mL) were added over 38 minutes by the double jet method. At this time, in the addition of the aqueous solution Ag-2, the flow rate was accelerated so that the final flow rate was 2.5 times the initial flow rate, and the addition of the aqueous solution X-2 was carried out so that pAg of a bulk emulsion solution in the reaction vessel was kept at 8.50 (addition 2).

Formation of First Shell

Then, 40 mL of an aqueous solution Ag-3 (containing 30.0 g of $AgNO_3$ in 100 mL) and an aqueous solution X-3 (containing 14.8 g of KBr and 7.0 g of KI in 100 mL) were added over 5 minutes by the double jet method. At this time, in the addition of the aqueous solution Ag-3, the flow rate was accelerated so that the final flow rate was 1.1 times the initial flow rate, and the addition of the aqueous solution X-3 was carried out so that pAg of a bulk emulsion solution in the reaction vessel was kept at 8.50 (addition 3).

Formation of Second Shell

Further, 160 mL of an aqueous solution Ag-4 (containing 25.0 g of $AgNO_3$ in 100 mL) and an aqueous solution X-4 (containing 20.0 g of KBr in 100 mL) were added over 18 minutes by the double jet method.

Then, desalting was performed by the usual flocculation method, and then, water, NaOH and the gelatin-1 were added while stirring to adjust the pH and pAg to 5.8 and 8.8, respectively, at 56° C.

The emulsion thus obtained contained tabular grains of an equivalent-sphere diameter of 0.5 μm, the average value of the equivalent-sphere diameter of major surface of 0.9 μm, the average value of grain thickness of 0.1 μm, the average value of aspect ratios of 9.2, the variation coefficient of the equivalent-sphere diameters of 15.0%, the average value of silver iodide contents of 1.5 mol %, with the parallel major surfaces of (111) face.

Subsequently, the emulsion was added with $8.0\times10^{-4}$ mol of the sensitizing dye Exs-1, specified below, per mol of silver halide, and then sequentially with potassium thiocyanate, chloroauric acid, sodium thiosulfate, and N,N-dimethylselenourea to perform the optimal chemical sensitization. Then, the chemical sensitization was completed by adding $3.5\times10^{-4}$ mol of the below-mentioned water-soluble mercapto compound EMR-1 per mol of silver halide.

Exs-1

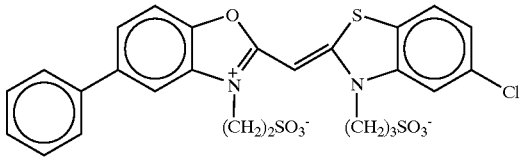

EMR-1

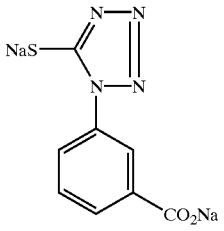

<Preparation Method of Emulsions VL-2 to VL-6>

Emulsions VL-2 to VL-5 were prepared by changing the addition amounts of Ag-2 and Ag-3, and the addition amounts of X-2 and X-3 in the preparation method of VL-1.

Further, an emulsion VL-6 was prepared by changing the addition amounts of Ag-2 to Ag-4, the addition amounts of X-2 to X-4, and the average amount of silver iodide of the first shell. The change of the average amount of silver iodide of the first shell was carried out by changing the amount of KI added to X-3. However, the amount of KBr was adjusted such that the halogen concentration of X-3 was constant.

Further, the chemical sensitizations of the respective emulsions were performed by changing the addition amounts of chloroauric acid, sodium thiosulfate, N,N-dimethylselenourea and the sensitizing dye Exs-b 1such that the chemical sensitizations were carried out optimally.

<Preparation Method of Emulsions VL-7 to VL-9>

Emulsions VL-7 to VL-9, in which the weight-averaged wavelength of spectral sensitivity distribution were changed, were prepared by replacing a portion of the sensitizing dye Exs-1 with the below-mentioned sensitizing dye Exs-2 in the preparation method of VL-5. The higher the proportion of the sensitizing Exs-2 is, the weight-averaged wavelength of spectral sensitivity distribution shifts to the longer wavelength side. Further, the chemical sensitizations of the respective emulsions were performed by changing the addition amounts of chloroauric acid, sodium thiosulfate, and N,N-dimethylselenourea such that the chemical sensitizations were carried out optimally.

Exs-2

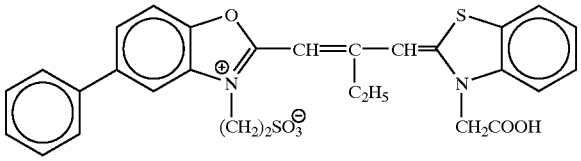

<Preparation of Sample 101>

(1) Preparation of Triacetylcellulose Film

Triacetylcellulose was dissolved (13% by weight) by a common solution casting process in dichloromethane/methanol=92/8 (weight ratio), and plastisizers, triphenyl phosphate and biphenyldiphenyl phosphate, in a weight ratio of 2:1, were added to the resultant solution so that the total amount of the plasticizers was 14% with respect to the triacetylcellulose. Then, a triacetylcellulose film was made by a band process. The thickness of the support after drying was 97 μm.

(2) Composition of Undercoat Layer

The two surfaces of the triacetylcellulose film were undercoated with the following an undercoat solution. The numbers below represent the amount contained per liter (hereinafter referred to also as "L") of the undercoat solution.

The two surfaces of the triacetylcellulose film were subjected to corona discharge treatment before undercoating treatment.

| | |
|---|---|
| Gelatin | 10.0 g |
| Salicylic acid | 0.5 g |
| Glycerin | 4.0 g |
| Acetone | 700 mL |
| Methanol | 200 mL |
| Dichloromethane | 80 mL |
| Formaldehyde | 0.1 mg |
| Water to make | 1.0 L |

(3) Coating of Back Layers

One surface of the undercoated support was coated with the following back layers.

| | |
|---|---|
| 1st layer | |
| Binder: acid-processed gelatin (isoelectric point: 9.0) | 1.10 g |
| Polymeric latex: P-2 (average grain size: 0.1 μm) | 0.13 g |
| Polymeric latex: P-3 (average grain size: 0.2 μm) | 0.23 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-3 | 0.010 g |
| Surfactant W-6 | 3.0 mg |
| 2nd layer | |
| Biacid-processed gelatin (isoelectric point: 9.0) | 3.10 g |
| Polymeric latex: P-3 (average grain size: 0.2 μm) | 0.11 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |

-continued

| | |
|---|---|
| Surfactant W-3 | 0.010 g |
| Surfactant W-6 | 3.0 mg |
| Dye D-2 | 0.10 g |
| Dye D-10 | 0.12 g |
| Potassium sulfate | 0.25 g |
| Calcium chloride | 0.5 mg |
| Sodium hydroxide | 0.03 g |
| 3rd layer | |
| Binder: acid-processed gelatin (isoelectric point: 9.0) | 3.30 g |
| Surfactant W-3 | 0.020 g |
| Potassium sulfate | 0.30 g |
| Sodium hydroxide | 0.03 g |
| 4th layer | |
| Binder: lime-processed gelatin (isoelectric point: 5.4) | 1.15 g |
| 1:9 copolymer of methacrylic acid and methylmethacrylate (average grain size: 2.0 μm) | 0.040 g |
| 6:4 copolyiner of methacrylic acid and methylmethacrylate (average grain size: 2.0 μm) | 0.030 g |
| Surfactant W-3 | 0.060 g |
| Surfactant W-2 | 7.0 mg |
| Hardener H-1 | 0.23 g |

(4) Coating of Photosensitive Emulsion Layers

Sample 101 was made by coating photosensitive emulsion layers shown below on the side opposite, against the support, to the side having the back layers. The numbers below represent addition amounts per $m^2$ of the coated surface. Note that the effects of added compounds are not restricted to the described purposes.

| | |
|---|---|
| 1st layer: Antihalation layer | |
| Black colloidal silver | 0.25 g |
| Gelatin | 2.40 g |
| Ultraviolet absorbent U-1 | 0.15 g |
| Ultraviolet absorbent U-3 | 0.15 g |
| Ultraviolet absorbent U-4 | 0.10 g |
| Ultraviolet absorbent U-5 | 0.10 g |
| High-boiling organic solvent Oil-1 | 0.10 g |
| High-boiling organic solvent Oil-2 | 0.10 g |
| High-boiling organic solvent Oil-5 | 0.010 g |
| Dye D-4 | 1.0 mg |
| Dye D-3 | 2.5 mg |
| Fine crystal solid dispersion of dye E-1 | 0.05 g |
| 2nd layer: 1st interlayer | |
| Gelatin | 0.50 g |
| Compound Cpd-A | 0.2 mg |
| Compound Cpd-K | 3.0 mg |
| Compound Cpd-M | 0.030 g |
| Ultraviolet absorbent U-6 | 6.0 mg |
| High-boiling organic solvent Oil-3 | 0.010 g |
| High-boiling organic solvent Oil-4 | 0.010 g |
| High-boiling organic solvent Oil-7 | 2.0 mg |
| Dye D-7 | 4.0 mg |
| 3rd layer: 2nd interlayer | |
| Yellow colloidal silver | 0.020 g |
| Silver iodobromide emulsion whose surface and interior were previously fogged (cubic, average silver iodide content: 1 mol%, equivalent-sphere average grain size: 0.06 μm), silver | 0.01 g |
| Gelatin | 0.60 g |
| Compound Cpd-D | 0.020 g |
| High-boiling organic solvent Oil-3 | 0.010 g |
| High-boiling organic solvent Oil-8 | 0.010 g |

-continued

4th layer: Low-speed red sensitive emulsion layer

| | | | |
|---|---|---|---|
| Emulsion A | silver | 0.10 | g |
| Emulsion B | silver | 0.15 | g |
| Emulsion C | silver | 0.15 | g |
| Gelatin | | 0.80 | g |
| Coupler C-1 | | 0.15 | g |
| Coupler C-2 | | 7.0 | mg |
| Coupler C-10 | | 3.0 | mg |
| Coupler C-11 | | 2.0 | mg |
| Ultraviolet absorbent U-3 | | 0.010 | g |
| Compound Cpd-I | | 0.020 | g |
| Compound Cpd-D | | 3.0 | mg |
| Compound Cpd-J | | 2.0 | mg |
| High-boiling organic solvent Oil-10 | | 0.030 | g |
| Additive P-1 | | 5.0 | mg |

5th layer: Medium-speed red-sensitive emulsion layer

| | | | |
|---|---|---|---|
| Emulsion C | silver | 0.15 | g |
| Emulsion D | silver | 0.15 | g |
| Gelatin | | 0.70 | g |
| Coupler C-1 | | 0.15 | g |
| Coupler C-2 | | 7.0 | mg |
| Coupler C-10 | | 3.0 | mg |
| Compound Cpd-D | | 3.0 | mg |
| Ultraviolet absorbent U-3 | | 0.010 | g |
| High-boiling organic solvent Oil-10 | | 0.030 | g |
| Additive P-1 | | 7.0 | mg |

6th layer: High-speed red-sensitive emulsion layer

| | | | |
|---|---|---|---|
| Emulsion E | silver | 0.15 | g |
| Emulsion F | silver | 0.20 | g |
| Gelatin | | 1.50 | g |
| Coupler C-1 | | 0.60 | g |
| Coupler C-2 | | 0.015 | g |
| Coupler C-3 | | 0.030 | g |
| Coupler C-10 | | 5.0 | mg |
| Ultraviolet absorbent U-1 | | 0.010 | g |
| Ultraviolet absorbent U-2 | | 0.010 | g |
| High-boiling organic solvent Oil-6 | | 0.030 | g |
| High-boiling organic solvent Oil-9 | | 0.020 | g |
| High-boiling organic solvent Oil-10 | | 0.050 | g |
| Compound Cpd-D | | 5.0 | mg |
| Compound Cpd-K | | 1.0 | mg |
| Compound Cpd-F | | 0.030 | g |
| Compound Cpd-L | | 1.0 | mg |
| Additive P-1 | | 0.010 | g |
| Additive P-4 | | 0.030 | g |

7th layer: 3rd interlayer

| | | | |
|---|---|---|---|
| Gelatin | | 1.40 | g |
| Additive P-2 | | 0.15 | g |
| Dye D-5 | | 0.020 | g |
| Dye D-9 | | 6.0 | mg |
| Compound Cpd-A | | 0.050 | g |
| Compound Cpd-D | | 0.030 | g |
| Compound Cpd-I | | 0.010 | g |
| Compound Cpd-M | | 0.090 | g |
| Compound Cpd-O | | 3.0 | mg |
| Compound Cpd-P | | 5.0 | mg |
| High-boiling organic solvent Oil-3 | | 0.010 | g |
| High-boiling organic solvent Oil-6 | | 0.100 | g |
| Ultraviolet absorbent U-1 | | 0.010 | g |
| Ultraviolet absorbent U-3 | | 0.010 | g |

8th layer: Low-speed green-sensitive emulsion layer

| | | | |
|---|---|---|---|
| Emulsion G | silver | 0.25 | g |
| Emulsion H | silver | 0.30 | g |
| Emulsion I | silver | 0.25 | g |
| Silver iodobromide emulsion whose surface and interior were previously fogged (cubic, average silver iodide content: 1 mol %, equivalent-sphere average grain size: 0.06 $\mu$m), silver | | 0.010 | g |
| Gelatin | | 1.30 | g |
| Coupler C-4 | | 0.20 | g |
| Coupler C-5 | | 0.050 | g |
| Coupler C-6 | | 0.020 | g |
| Compound Cpd-A | | 5.0 | mg |
| Compound Cpd-B | | 0.030 | g |

-continued

| | | | |
|---|---|---|---|
| Compound Cpd-D | | 5.0 | mg |
| Compound Cpd-F | | 0.010 | g |
| Compound Cpd-G | | 2.5 | mg |
| Compound Cpd-K | | 2.0 | mg |
| Ultraviolet absorbent U-6 | | 5.0 | mg |
| High-boiling organic solvent Oil-2 | | 0.25 | g |
| Additive P-1 | | 5.0 | mg |

9th layer: Medium-speed green-sensitive emulsion layer

| | | | |
|---|---|---|---|
| Emulsion I | silver | 0.30 | g |
| Emulsion J | silver | 0.30 | g |
| Gelatin | | 0.70 | g |
| Coupler C-4 | | 0.25 | g |
| Coupler C-5 | | 0.050 | g |
| Coupler C-6 | | 0.020 | g |
| Compound Cpd-A | | 5.0 | mg |
| Compound Cpd-B | | 0.030 | g |
| Compound Cpd-F | | 0.010 | g |
| Compound Cpd-G | | 2.0 | mg |
| High-boiling organic solvent Oil-2 | | 0.20 | g |
| High-boiling organic solvent Oil-9 | | 0.050 | g |

10th layer: High-speed green-sensitive emulsion layer

| | | | |
|---|---|---|---|
| Emulsion K | silver | 0.40 | g |
| Gelatin | | 0.80 | g |
| Coupler C-4 | | 0.30 | g |
| Coupler C-5 | | 0.080 | g |
| Coupler C-7 | | 0.050 | g |
| Compound Cpd-A | | 5.0 | mg |
| Compound Cpd-B | | 0.030 | g |
| Compound Cpd-F | | 0.010 | g |
| High-boiling organic solvent Oil-2 | | 0.20 | g |
| High-boiling organic solvent Oil-9 | | 0.050 | g |

11th layer: Yellow filter layer

| | | | |
|---|---|---|---|
| Gelatin | | 1.0 | g |
| Compound Cpd-C | | 0.010 | g |
| Compound Cpd-M | | 0.10 | g |
| High-boiling organic solvent Oil-1 | | 0.020 | g |
| High-boiling organic solvent Oil-6 | | 0.10 | g |
| Fine crystal solid dispersion of dye E-2 | | 0.25 | g |

12th layer: Short wavelength blue-sensitive emulsion layer (VL layer)

| | | | |
|---|---|---|---|
| Emulsion VL-1 | silver | 0.27 | g |
| Gelatin | | 0.40 | g |
| Compound Cpd-Q | | 0.20 | g |

13th layer: 4th Interlayer

| | | | |
|---|---|---|---|
| Gelatin | | 0.40 | g |
| Compound Cpd-Q | | 0.20 | g |
| Dye D-6 | | 3.0 | mg |

14th layer: Low-speed long wavelength blue-sensitive emulsion layer

| | | | |
|---|---|---|---|
| Emulsion L | silver | 0.15 | g |
| Emulsion M | silver | 0.20 | g |
| Emulsion N | silver | 0.10 | g |
| Silver iodobromide emulsion whose surface and interior were previously fogged (cubic, average silver iodide content: 1 mol %, equivalent-sphere average grain size: 0.06 $\mu$m), silver | | 3.0 | mg |
| Gelatin | | 0.80 | g |
| Coupler C-8 | | 0.020 | g |
| Coupler C-9 | | 0.30 | g |
| Coupler C-10 | | 5.0 | mg |
| Compound Cpd-B | | 0.10 | g |
| Compound Cpd-I | | 8.0 | mg |
| Compound Cpd-K | | 1.0 | mg |
| Compound Cpd-M | | 0.010 | g |
| Ultraviolet absorbent U-6 | | 0.010 | g |
| High-boiling organic solvent Oil-2 | | 0.010 | g |

15th layer: Medium-speed long wavelength blue-sensitive emulsion layer

| | | | |
|---|---|---|---|
| Emulsion N | silver | 0.20 | g |
| Emulsion O | silver | 0.20 | g |
| Silver bromide emulsion whose interior was | | 3.0 | mg |

-continued

| | | | |
|---|---|---|---|
| previously fogged (cubic, equivalent-sphere average grain size: 0.11 μm), | silver | | |
| Gelatin | | 0.80 | g |
| Coupler C-8 | | 0.020 | g |
| Coupler C-9 | | 0.25 | g |
| Coupler C-10 | | 0.010 | g |
| Compound Cpd-B | | 0.10 | g |
| Compound Cpd-E | | 0.030 | g |
| Compound Cpd-N | | 2.0 | mg |
| High-boiling organic solvent Oil-2 | | 0.010 | g |
| 16th layer: High-speed long wavelength blue-sensitive emulsion layer | | | |
| Emulsion P | silver | 0.20 | g |
| Emulsion Q | silver | 0.25 | g |
| Gelatin | | 2.00 | g |
| Coupler C-3 | | 5.0 | mg |
| Coupler C-8 | | 0.10 | g |
| Coupler C-9 | | 1.00 | g |
| Coupler C-10 | | 0.020 | g |
| High-boiling organic solvent Oil-2 | | 0.10 | g |
| High-boiling organic solvent Oil-3 | | 0.020 | g |
| Ultraviolet absorbent U-6 | | 0.10 | g |
| Compound Cpd-B | | 0.20 | g |
| Compound Cpd-N | | 5.0 | mg |
| 17th layer: 1st protective layer | | | |
| Gelatin | | 1.00 | g |
| Ultraviolet absorbent U-1 | | 0.15 | g |
| Ultraviolet absorbent U-2 | | 0.050 | g |
| Ultraviolet absorbent U-5 | | 0.20 | g |
| Compound Cpd-O | | 5.0 | mg |
| Compound Cpd-A | | 0.030 | g |
| Compound Cpd-H | | 0.20 | g |

-continued

| | | | |
|---|---|---|---|
| Dye D-1 | | 8.0 | mg |
| Dye D-2 | | 0.010 | g |
| Dye D-3 | | 0.010 | g |
| High-boiling organic solvent Oil-3 | | 0.10 | g |
| 18th layer: 2nd protective layer | | | |
| Colloidal silver | silver | 2.5 | mg |
| Fine grain silver iodobromide emulsion (average silver iodide content: 1 mol %, equivalent-sphere average grain size: 0.06 μm), | silver | 0.10 | g |
| Gelatin | | 0.80 | g |
| Ultraviolet absorbent U-1 | | 0.030 | g |
| Ultraviolet absorbent U-6 | | 0.030 | g |
| High-boiling organic solvent Oil-3 | | 0.010 | g |
| 19th layer: 3rd protective layer | | | |
| Gelatin | | 1.00 | g |
| Polymethylmethacrylate (average grain size: 1.5 μm) | | 0.10 | g |
| 6:4 copolymer of methylmethacrylate and methacrylic acid (average grain size 1.5 μm) | | 0.15 | g |
| Silicone oil SO-1 | | 0.20 | g |
| Surfactant W-1 | | 3.0 | mg |
| Surfactant W-2 | | 8.0 | mg |
| Surfactant W-3 | | 0.040 | g |
| Surfactant W-7 | | 0.015 | g |

In addition to the above compositions, additives F-1 to F-9 were added to all emulsion layers. Also, a gelatin hardener H-1 and surfactants W-3, W-4, W-5, and W-6 for coating and emulsification were added to each layer.

Furthermore, phenol, 1,2-benzisothiazoline-3-one, 2-phenoxyethanol, phenethylalcohol, and butyl p-benzoate were added as antiseptic and mildewproofing agents.

TABLE 1

Silver halide emulsions used in Sample 101

| Emulsion | Characteristics | Av. ESD (μm) | COV (%) | Av. silver iodide content (mol %) | Structure in halide composition of silver halide grains | Silver iodide content at grain surface (mol %) | Other characteristics (1) | (2) | (3) | (4) | (5) |
|---|---|---|---|---|---|---|---|---|---|---|---|
| A | Monodispersed tetradecahedral grains | 0.24 | 9 | 3.5 | Triple structure | 1.5 | | ○ | ○ | ○ | |
| B | Monodispersed (111) tabular grains Av. aspect ratio 2.0 | 0.25 | 10 | 3.5 | Quadruple structure | 1.5 | | ○ | | ○ | ○ |
| C | Monodispersed (111) tabular grains Av. aspect ratio 2.0 | 0.30 | 19 | 3.0 | Triple structure | 1.5 | ○ | ○ | | ○ | ○ |
| D | Monodispersed (111) tabular grains Av. aspect ratio 3.0 | 0.35 | 21 | 4.8 | Triple structure | 2.0 | ○ | ○ | | | ○ |
| E | Monodispersed (111) tabular grains Av. aspect ratio 3.0 | 0.50 | 10 | 2.0 | Quadruple structure | 1.5 | ○ | ○ | | | ○ |
| F | Monodispersed (111) tabular grains Av. aspect ratio 4.5 | 0.65 | 12 | 1.6 | Triple structure | 1.0 | ○ | ○ | | | ○ |
| G | Monodispersed cubic grains | 0.20 | 10 | 3.5 | Quadruple structure | 1.5 | | | ○ | ○ | |
| H | Monodispersed cubic grains | 0.24 | 12 | 4.9 | Quadruple structure | 2.1 | | | | ○ | |
| I | Monodispersed (111) tabular grains Av. aspect ratio 4.0 | 0.30 | 12 | 3.5 | Quintuple structure | 2.5 | ○ | ○ | | ○ | ○ |
| J | Monodispersed (111) tabular grains Av. aspect ratio 5.0 | 0.45 | 21 | 3.0 | Quadruple structure | 2.2 | ○ | ○ | | | ○ |

TABLE 1-continued

Silver halide emulsions used in Sample 101

| Emulsion | Characteristics | Av. ESD (μm) | COV (%) | Av. silver iodide content (mol %) | Structure in halide composition of silver halide grains | Silver iodide content at grain surface (mol %) | Other characteristics (1) | (2) | (3) | (4) | (5) |
|---|---|---|---|---|---|---|---|---|---|---|---|
| K | Monodispersed (111) tabular grains Av. aspect ratio 5.5 | 0.60 | 13 | 2.7 | Triple structure | 1.3 | ○ | ○ | | | ○ |
| L | Monodispersed tetradecahedral grains | 0.31 | 9 | 5.0 | Triple structure | 6.0 | | | ○ | ○ | |
| M | Monodispersed tetradecahedral grains | 0.31 | 9 | 5.0 | Triple structure | 5.5 | | | | ○ | |
| N | Monodispersed (111) tabular grains Av. aspect ratio 3.0 | 0.33 | 13 | 2.2 | Quadruple structure | 3.2 | ○ | ○ | | ○ | ○ |
| O | Monodispersed (111) tabular grains Av. aspect ratio 3.0 | 0.43 | 9 | 2.2 | Quadruple structure | 1.0 | ○ | ○ | | | ○ |
| P | Monodispersed (111) tabular grains Av. aspect ratio 6.0 | 0.75 | 21 | 2.0 | Triple structure | 0.5 | ○ | ○ | | | ○ |
| Q | Monodispersed (111) tabular grains Av. aspect ratio 6.0 | 0.90 | 8 | 1.0 | Quadruple structure | 0.5 | ○ | ○ | | | ○ |

Av. ESD = Equivalent-sphere average grain size;
COV = Coefficient of variation
(Other characteristics)
The mark "○" means each of the conditions set forth below is satisfied.
(1) A reduction sensitizer was added during grain formation;
(2) A selenium sensitizer was used as an after-ripening agent
(3) A rhodium salt was added during grain formation.
(4) A shell was provided subsequent to after-ripening by using silver nitrate in an amount of 10%, in terms of silver molar ratio, of the emulsion grains at that time, together with the equimolar amount of potassium bromide
(5) The presence of dislocation lines in an average number of ten or more per grain was observed by a transmission electron microscope.
Note that all the lightsensitive emulsion were after-ripped by the use of sodium thiosulfate, sodium thiocyanate, and sodium aurichloride. Note, also, a iridium salt was added during grain formation.
Note, also, that chemically-modified gelatin whose amino groups were partially converted to phthalic acid amide, was added to emulsions B, C, E, H, J, N, and Q.

TABLE 2

| Emulsion | Spectral sensitizing dye added | Addition amount per mol of silver halide (g) | Addition timing of the spectral sensitizing dye |
|---|---|---|---|
| A | S-1 | 0.04 | Subsequent to after-ripening |
| | S-2 | 0.20 | same as above |
| | S-3 | 0.20 | same as above |
| | S-4 | 0.01 | same as above |
| B | S-2 | 0.60 | Before after-ripening |
| | S-3 | 0.10 | same as above |
| | S-4 | 0.01 | same as above |
| C | S-2 | 0.50 | Before after-ripening |
| | S-3 | 0.08 | same as above |
| | S-4 | 0.01 | same as above |
| D | S-2 | 0.43 | Before after-ripening |
| | S-3 | 0.09 | same as above |
| | S-4 | 0.01 | same as above |
| E | S-2 | 0.30 | Before after-ripening |
| | S-3 | 0.07 | same as above |
| | S-4 | 0.01 | same as above |
| F | S-2 | 0.25 | Before after-ripening |

TABLE 2-continued

| Emulsion | Spectral sensitizing dye added | Addition amount per mol of silver halide (g) | Addition timing of the spectral sensitizing dye |
|---|---|---|---|
| | S-3 | 0.05 | same as above |
| | S-4 | 0.01 | same as above |
| G | S-5 | 0.70 | Subsequent to after-ripening |
| | S-7 | 0.10 | same as above |
| | S-8 | 0.10 | same as above |
| H | S-5 | 0.30 | Subsequent to after-ripening |
| | S-6 | 0.30 | same as above |
| | S-7 | 0.06 | same as above |
| | S-8 | 0.06 | same as above |
| I | S-5 | 0.50 | Before after-ripening |
| | S-7 | 0.08 | same as above |
| | S-8 | 0.08 | same as above |
| J | S-5 | 0.40 | Before after-ripening |
| | S-7 | 0.10 | same as above |
| | S-8 | 0.10 | same as above |
| K | S-6 | 0.50 | Before after-ripening |
| | S-7 | 0.13 | same as above |
| | S-8 | 0.13 | same as above |

TABLE 2-continued

| Emulsion | Spectral sensitizing dye added | Addition amount per mol of silver halide (g) | Addition timing of the spectral sensitizing dye |
|---|---|---|---|
| L, M | S-10 | 0.90 | Before after-ripening |
| | S-11 | 0.12 | same as above |
| | S-12 | 0.12 | same as above |
| N | S-10 | 0.65 | Before after-ripening |
| | S-11 | 0.11 | same as above |
| | S-12 | 0.11 | same as above |
| O | S-10 | 0.50 | Before after-ripening |
| | S-11 | 0.18 | same as above |
| P | S-10 | 0.30 | Before after-ripening |
| | S-11 | 0.06 | same as above |
| | S-13 | 0.06 | same as above |
| Q | S-9 | 0.26 | Before after-ripening |
| | S-11 | 0.05 | same as above |
| | S-13 | 0.05 | same as above |

TABLE 3

| Sample No. | Emulsion No. | Emulsion characteristics | COV (%) | Av. silver iodide content (mol %) | Silver amount ratio (mol % of each layer to the whole grain silver amount) | I distribution (silver iodide content (mol %) of each layer) |
|---|---|---|---|---|---|---|
| 100 | none | | | | | |
| 101 | VL-1 | Monodisperse t.g. Aspect ratio 9.0 | 15.0 | 1.5 | core/1st shell/2nd shell 74/6/20 | core/1st shell/2nd shell 0/25/0 |
| 102 | VL-2 | Monodisperse t.g. Aspect ratio 8.8 | 15.0 | 2.0 | core/1st shell/2nd shell 72/8/20 | core/1st shell/2nd shell 0/25/0 |
| 103 | VL-3 | Monodisperse t.g. Aspect ratio 8.5 | 16.1 | 4.0 | core/1st shell/2nd shell 64/16/20 | core/1st shell/2nd shell 0/25/0 |
| 104 | VL-4 | Monodisperse t.g. Aspect ratio 8.0 | 15.8 | 8.0 | core/1st shell/2nd shell 48/32/20 | core/1st shell/2nd shell 0/25/0 |
| 105 | VL-5 | Monodisperse t.g. Aspect ratio 7.5 | 17.6 | 12.0 | core/1st shell/2nd shell 32/48/20 | core/1st shell/2nd shell 0/25/0 |
| 106 | VL-6 | Monodisperse t.g. Aspect ratio 7.0 | 19.6 | 24.0 | core/1st shell/2nd shell 10/75/15 | core/1st shell/2nd shell 0/32/0 |
| 107 | VL-7 | Monodisperse t.g. Aspect ratio 7.5 | 17.6 | 12.0 | core/1st shell/2nd shell 32/48/20 | core/1st shell/2nd shell 0/25/0 |
| 108 | VL-8 | Monodisperse t.g. Aspect ratio 7.5 | 17.6 | 12.0 | core/1st shell/2nd shell 32/48/20 | core/1st shell/2nd shell 0/25/0 |
| 109 | VL-9 | Monodisperse t.g. Aspect ratio 7.5 | 17.6 | 12.0 | core/1st shell/2nd shell 32/48/20 | core/1st shell/2nd shell 0/25/0 |
| 110 | VL-5 | Monodisperse t.g. Aspect ratio 7.5 | 17.6 | 12.0 | core/1st shell/2nd shell 32/48/20 | core/1st shell/2nd shell 0/25/0 |
| 111 | VL-5 | Monodisperse t.g. Aspect ratio 7.5 | 17.6 | 12.0 | core/1st shell/2nd shell 32/48/20 | core/1st shell/2nd shell 0/25/0 |
| 112 | VL-5 | Monodisperse t.g. Aspect ratio 7.5 | 17.6 | 12.0 | core/1st shell/2nd shell 32/48/20 | core/1st shell/2nd shell 0/25/0 |
| 113 | VL-5 | Monodisperse t.g. Aspect ratio 7.5 | 17.6 | 12.0 | core/1st shell/2nd shell 32/48/20 | core/1st shell/2nd shell 0/25/0 |

| Sample No | Dye used | Weight-averaged wavelength of Spectral sensitivity distribution λv (nm) | Yellow coupler (color density) | Position of short-wavelength blue-sensitive emulsion layer | Remarks |
|---|---|---|---|---|---|
| 100 | | | | absent | Comp. |
| 101 | ExS-1 | 439 | absent | 12th layer | Inv. |
| 102 | ExS-1 | 439 | absent | 12th layer | Inv. |
| 103 | ExS-1 | 440 | absent | 12th layer | Inv. |
| 104 | ExS-1 | 441 | absent | 12th layer | Inv. |
| 105 | ExS-1 | 442 | absent | 12th layer | Inv. |
| 106 | ExS-1 | 445 | absent | 12th layer | Inv. |
| 107 | ExS-1 | 452 | absent | 12th layer | Inv. |

TABLE 3-continued
| | | | | | |
|---|---|---|---|---|---|
| | ExS-2 | | | | |
| 108 | ExS-1 | 460 | absent | 12th layer | Inv. |
| | ExS-2 | | | | |
| 109 | ExS-1 | 468 | absent | 12th layer | Comp. |
| | ExS-2 | | | | |
| 110 | ExS-1 | 442 | Present (0.2) | 12th layer | Inv. |
| 111 | ExS-1 | 442 | present (0.3) | 12th layer | Inv. |
| 112 | ExS-1 | 442 | Present (0.4) | 12th layer | Comp. |
| 113 | ExS-1 | 442 | absent | Between 15th and 16th layers | Inv. |
t.g. = tabular grain
C-1
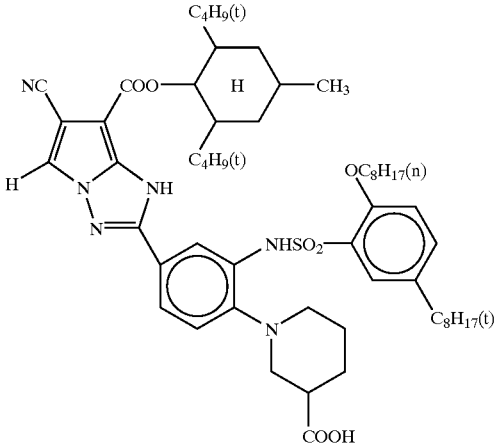
C-2
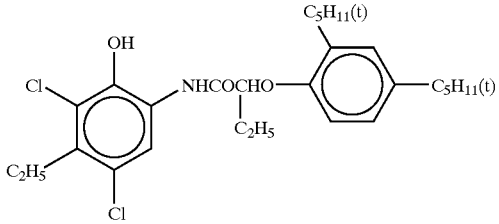
C-3
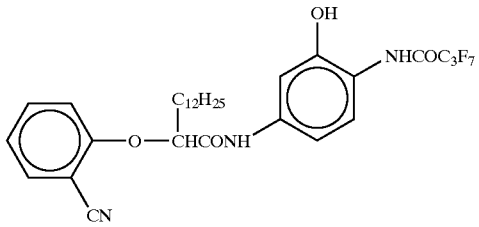
C-4
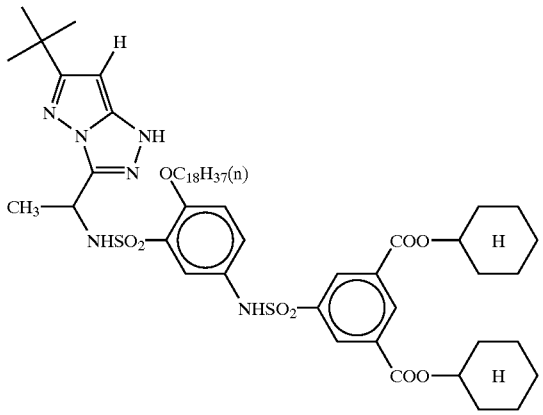

-continued
C-5
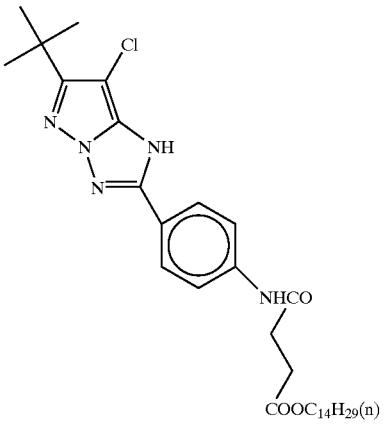
C-6
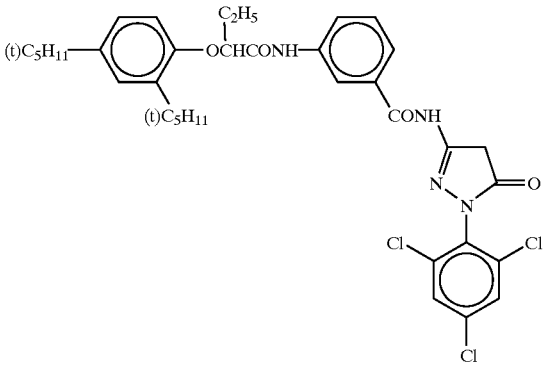
C-7
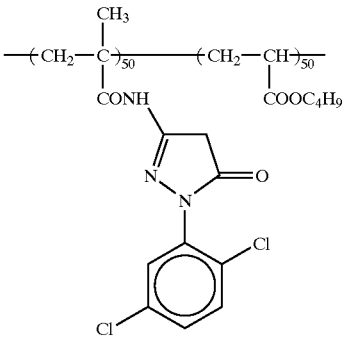
The numbers are in weight %
Average mol. weight
: about 25,000
C-8
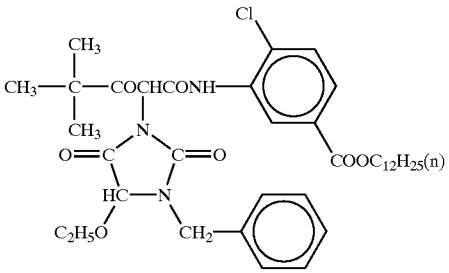
C-9
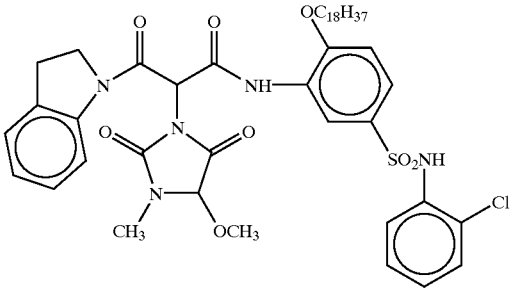
C-10
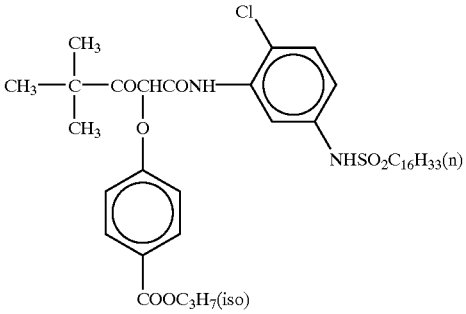
C-11
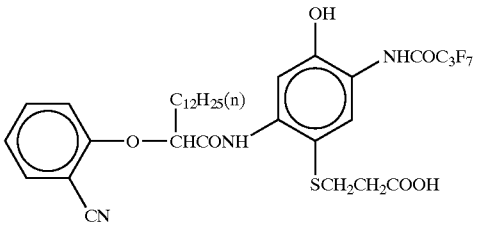
Oil-1
Tri-n-hexyl phosphate
Oil-2
Tricresyl phosphate
Oil-3
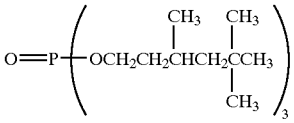
Oil-4
Tricyclohexyl phosphate
Oil-5
Bis(2-ethylhexyl) succinate -continued
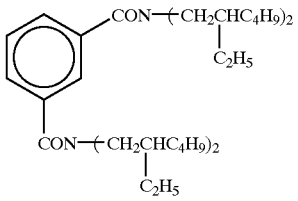
Oil-6
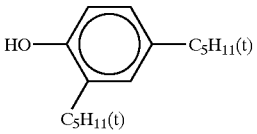
Oil-7
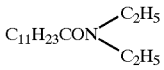
Oil-8
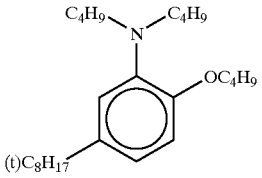
Oil-9
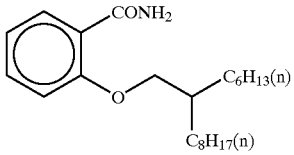
Oil-10
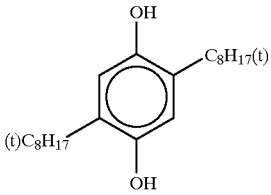
Cpd-A
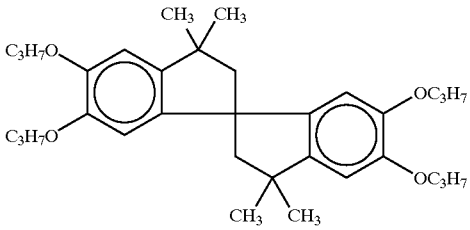
Cpd-B
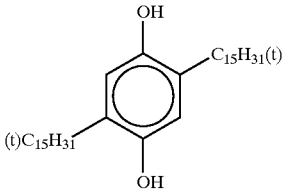
Cpd-C
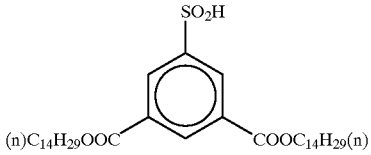
Cpd-D
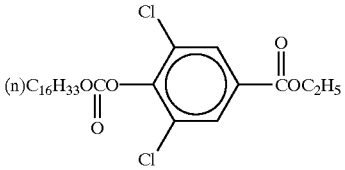
Cpd-F
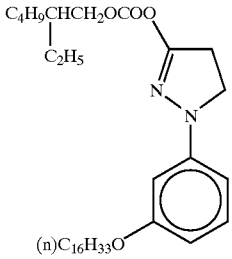
Cpd-G
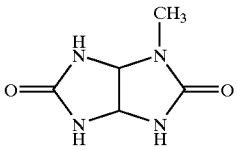
Cpd-H
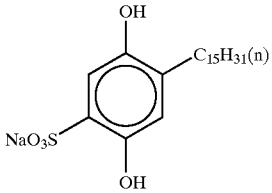
Cpd-I
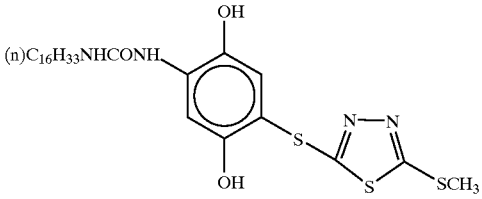
Cpd-J -continued
Cpd-K
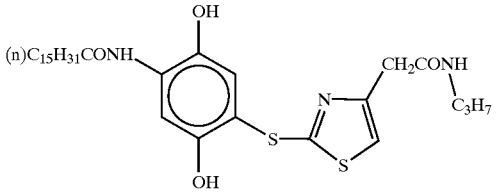
Cpd-L
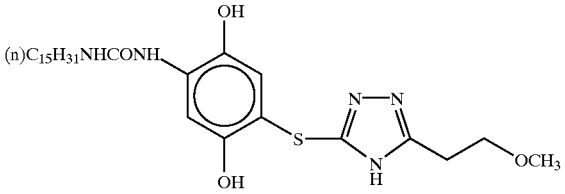
Cpd-M
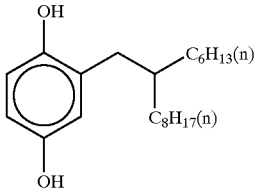
Cpd-N
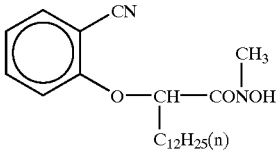
Cpd-O
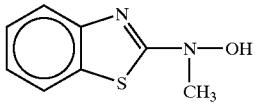
Cpd-P
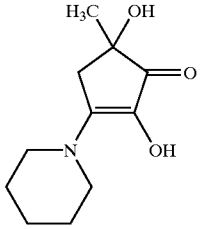
Cpd-Q
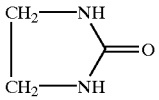
U-1
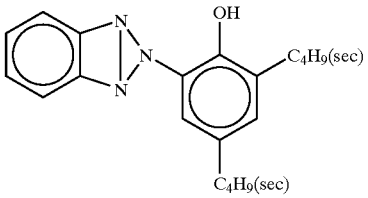
U-2
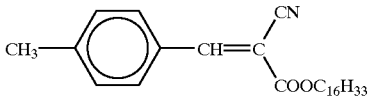
U-3
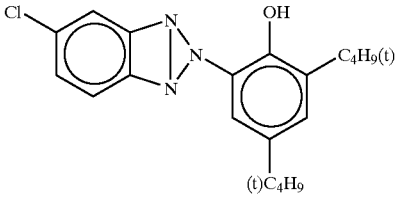
U-4
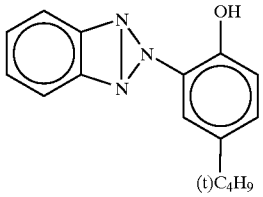
U-5
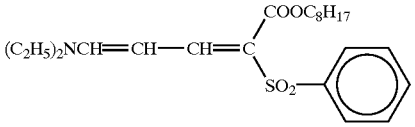
U-6
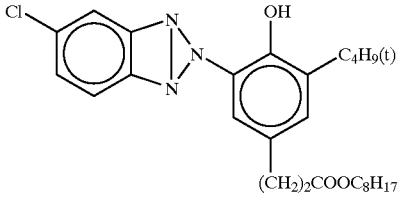
S-1
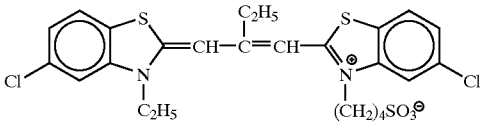

-continued
S-2
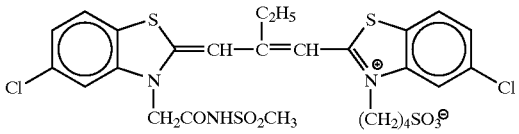
S-3
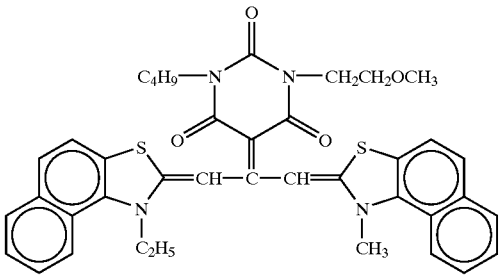
S-4
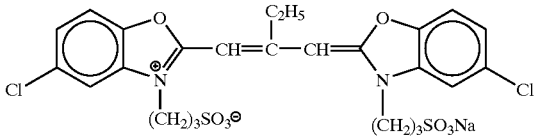
S-5
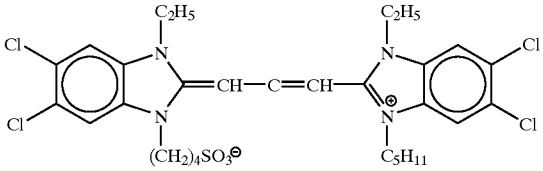
S-6
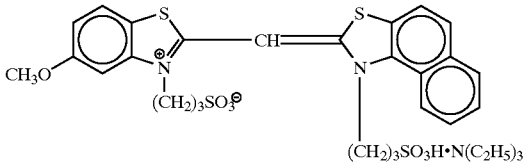
S-7
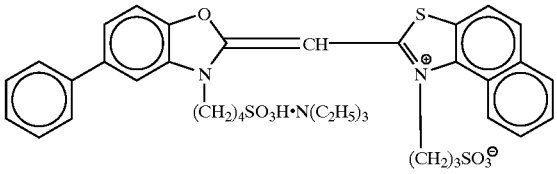
S-8
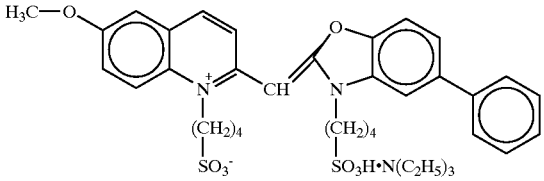
S-9
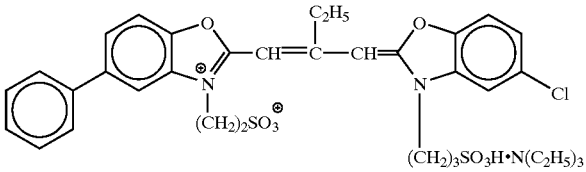
S-10
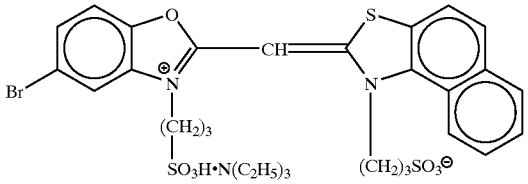
S-11
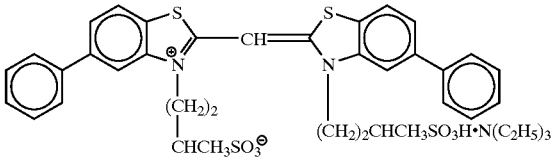
S-12
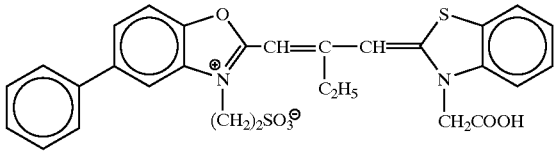
S-13
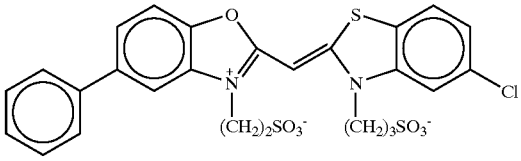
D-1
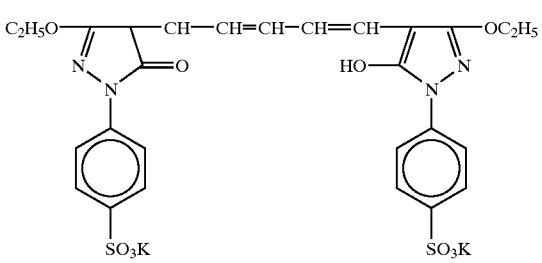
D-2
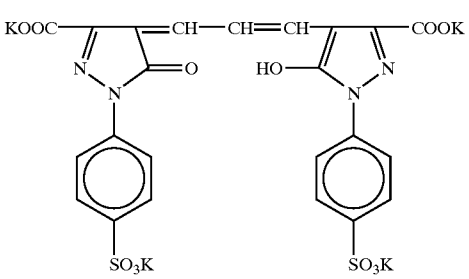

-continued
D-3
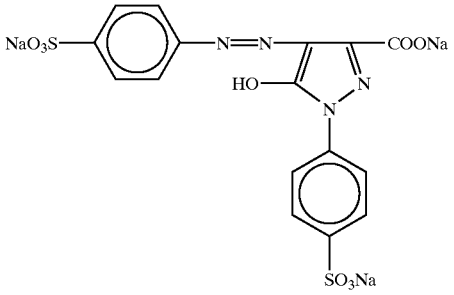
D-4
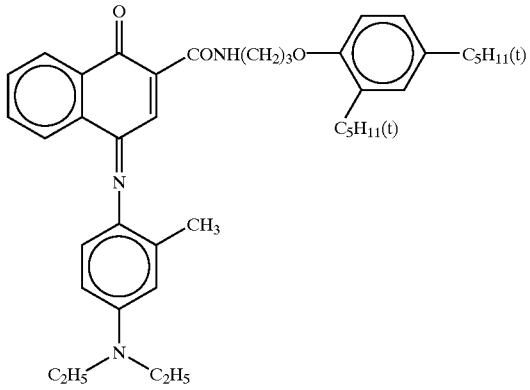
D-5
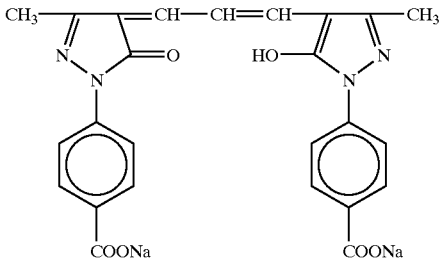
D-6
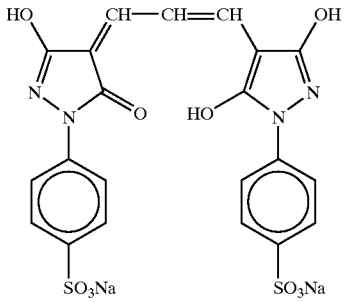
D-7
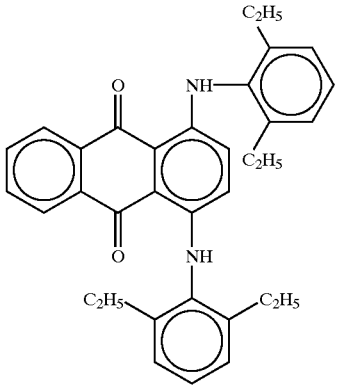
D-8
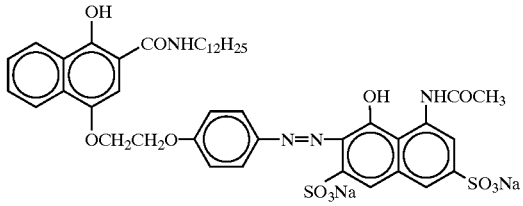
D-9
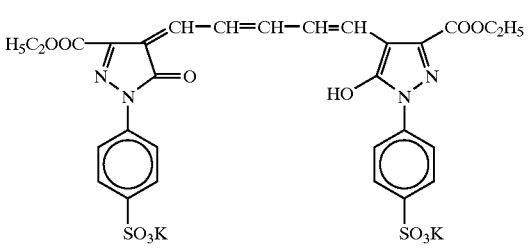
D-10
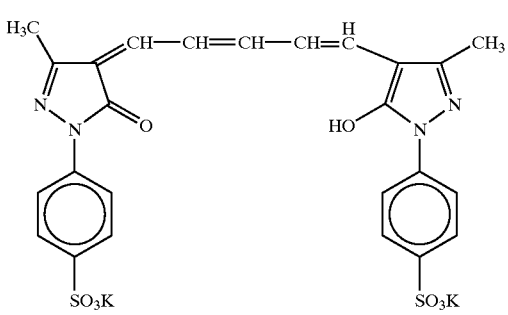
E-1
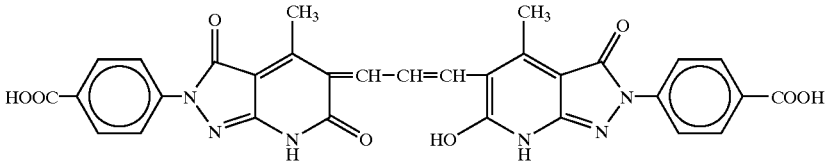

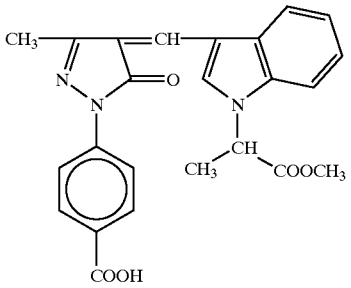
$C_8F_{17}SO_2NHCH_2CH_2CH_2OCH_2CH_2\overset{\oplus}{N}(CH_3)_3$
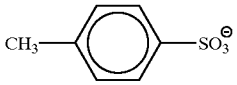
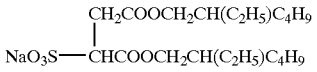
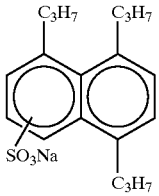
$C_8F_{17}SO_3Li$
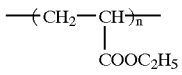
(n = 100 – 1000)
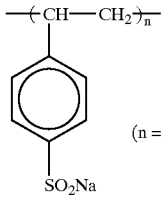
(n = 100 –1000)
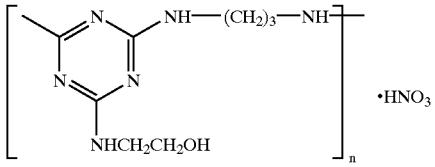
(n = 3 ~ 4)
-continued
E-2
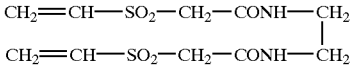
H-1
W-1
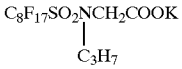
W-2
W-3
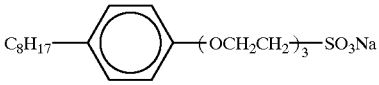
W-4
W-5
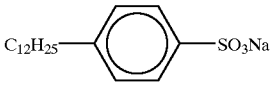
W-6
W-7
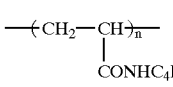
(n = 100 – 1000)
P-1
P-2
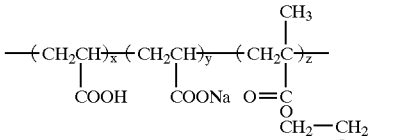
x:y:z = 42.5:7.5:50
P-3
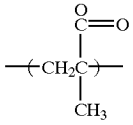
P-4
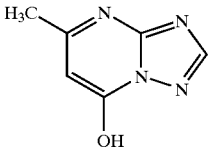
F-1
F-2
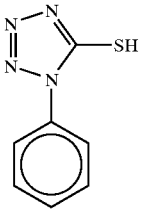
F-3

-continued

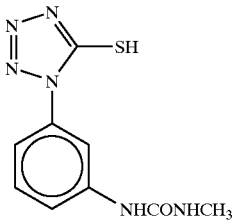

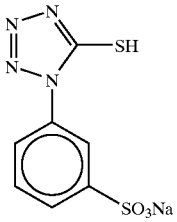

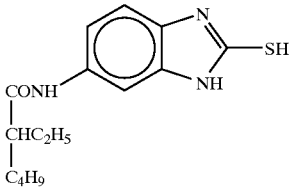

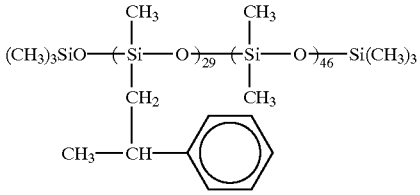

F-4

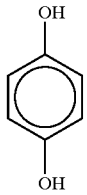

F-5

F-6

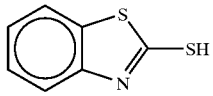

F-7

F-8

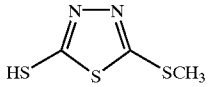

F-9

SO-1

Preparation of Dispersion of Organic Solid Disperse Dye

<Preparation of Fine Crystalline Solid Dispersion of Dye E-1>

100 g of Pluronic F88 (an ethylene oxide-propylene oxide block copolymer) manufactured by BASF CORP. and water were added to a wet cake of the dye E-1 (the net weight of E-1 was 270 g) to make 4,000 g, and the resultant material was stirred. Next, the Ultra Visco Mill (UVM-2) manufactured by Imex K.K. was charged with 1,700 mL of zirconia beads with an average grain size of 0.5 mm, and the slurry was milled through this UVM-2 at a peripheral speed of approximately 10 m/sec and a discharge rate of 0.5 L/min for 2 hours. The beads were filtered out, and water was added to dilute the material to a dye concentration of 3%. Then, the material was heated at 90° C. for 10 hours for stabilization. The average grain size of the obtained fine dye grains was 0.30 $\mu$m, and the grain size distribution (grain size standard deviation×100/average grain size) was 20%.

<Preparation of Fine Crystalline Solid Dispersion of Dye E-2>

Water and 270 g of W-4 were added to 1,400 g of a wet cake of E-2 containing 30% by weight of water, and the resultant material was stirred to form a slurry having an E-2 concentration of 40% by weight. Next, the Ultra Visco Mill (UVM-2) manufactured by Imex K.K. was charged with 1,700 mL of zirconia beads with an average grain size of 0.5 mm, and the slurry was milled through this UVM-2 at a peripheral speed of approximately 10 m/sec and a discharge rate of 0.5 L/min for 8 hours, thereby obtaining a fine crystalline solid dispersion of E-2. This dispersion was diluted to 20% by weight with ion exchanged water to obtain a desired fine crystalline solid dispersion. The average grain size was 0.15 $\mu$m.

In the Example, the development process shown below (development process A) was carried out. Incidentally, running processing was carried out on non-exposed sample 101 and completely exposed sample 101 in a ratio of 1:1 until the replenishment amount became 4 times the tank volume, and then the development process for evaluation was carried out.

| Processing Step | Time | Temperature | Tank volume | Replenishment rate |
|---|---|---|---|---|
| 1st development | 6 min | 38° C. | 37 L | 2,200 mL/m$^2$ |
| 1st washing | 2 min | 38° C. | 16 L | 4,000 mL/m$^2$ |
| Reversal | 2 min | 38° C. | 17 L | 1,100 mL/m$^2$ |
| Color development | 6 min | 38° C. | 30 L | 2,200 mL/m$^2$ |
| Pre-bleaching | 2 min | 38° C. | 19 L | 1,100 mL/m$^2$ |
| Bleaching | 6 min | 38° C. | 30 L | 220 mL/m$^2$ |
| Fixing | 4 min | 38° C. | 29 L | 1,100 mL/m$^2$ |
| 2nd washing | 4 min | 38° C. | 35 L | 4,000 mL/m$^2$ |
| Final rinsing | 1 min | 25° C. | 19 L | 1,100 mL/m$^2$ |

Each processing solution had the following compositon.

| <1st developer> | <Tank solution> | <Replenisher> |
|---|---|---|
| Nitrilo-N,N,N-trimethylene-phosphonic acid·pentasodium salt | 1.5 g | 1.5 g |
| Diethylenetriamine-pentaacetic acid·pentasodium salt | 2.0 g | 2.0 g |
| Sodium sulfite | 30 g | 30 g |
| Hydroquinone·potassium monosulfonate | 20 g | 20 g |
| Potassium carbonate | 15 g | 20 g |
| Potassium bicarbonate | 12 g | 15 g |
| 1-phenyl-4-methyl-4-hydroxymethyl-3-pyrazolidone | 2.5 g | 3.0 g |
| Potassium bromide | 2.5 g | 1.4 g |
| Potassium thiocyanate | 1.2 g | 1.2 g |
| Potassium iodide | 2.0 mg | — |
| Diethyleneglycol | 13 g | 15 g |
| Water to make | 1,000 mL | 1,000 mL |
| pH | 9.60 | 9.60 |

The pH was adjusted by sulfuric acid or potassium hydroxide.

| <Reversal solution> | <Tank solution> | <Replenisher> |
|---|---|---|
| Nitrilo-N,N,N-trimethylene-phosphonic acid·pentasodium salt | 3.0 g | the same as tank solution |
| Stannous chloride·dihydrate | 1.0 g | |
| p-aminophenol | 0.1 g | |
| Sodium hydroxide | 8 g | |
| Glacial acetic acid | 15 mL | |
| Water to make | 1,000 mL | |
| pH | 6.00 | |

The pH was adjusted by acetic acid or sodium hydroxide.

| <Color developer> | <Tank solution> | <Replenisher> |
|---|---|---|
| Nitrilo-N,N,N-trimethylene-phosphonic acid·pentasodium salt | 2.0 g | 2.0 g |
| Sodium sulfite | 7.0 g | 7.0 g |
| Trisodium phosphate·dodecahydrate | 36 g | 36 g |
| Potassium bromide | 1.0 g | — |
| Potassium iodide | 90 mg | — |
| Sodium hydroxide | 12.0 g | 12.0 g |
| Citrazinic acid | 0.5 g | 0.5 g |
| N-ethyl-N-(β-methanesulfon-amidoethyl)-3-methyl-4-aminoaniline·3/2 sulfuric acid·monohydrate | 10 g | 10 g |
| 3,6-dithiaoctane-1,8-diol | 1.0 g | 1.0 g |
| Water to make | 1,000 mL | 1,000 mL |
| pH | 11.80 | 12.00 |

The pH was adjusted by sulfuric acid or potassium hydroxide.

| <Pre-bleaching solution> | <Tank solution> | <Replenisher> |
|---|---|---|
| Ethylenediaminetetraacetic acid·disodium salt·dihydrate | 8.0 g | 8.0 g |
| Sodium sulfite | 6.0 g | 8.0 g |
| 1-thioglycerol | 0.4 g | 0.4 g |
| Formaldehyde sodium bisulfite adduct | 30 g | 35 g |
| Water to make | 1,000 mL | 1,000 mL |
| pH | 6.3 | 6.10 |

The pH was adjusted by acetic acid or sodium hydroxide.

| <Bleaching solution> | <Tank solution> | <Replenisher> |
|---|---|---|
| Ethylenediaminetetraacetic acid·disodium salt·dihydrate | 2.0 g | 4.0 g |
| Ethylenediaminetetraacetic acid·Fe(III)·ammonium·dihydrate | 120 g | 240 g |
| Potassium bromide | 100 g | 200 g |
| Ammonium nitrate | 10 g | 20 g |
| Water to make | 1,000 mL | 1,000 mL |
| pH | 5.70 | 5.50 |

The pH was adjusted by nitric acid or sodium hydroxide.

| <Fixing solution> | <Tank solution> | <Replenisher> |
|---|---|---|
| Ammonium thiosulfate | 80 g | the same as tank solution |
| Sodium sulfite | 5.0 g | |
| Sodium bisulfite | 5.0 g | |
| Water to make | 1,000 mL | |
| pH | 6.60 | |

The pH was adjusted by acetic acid or ammonia water.

| <Stabilizer> | <Tank solution> | <Replenisher> |
|---|---|---|
| 1,2-benzoisothiazoline-3-one | 0.02 g | 0.03 g |
| Polyoxyethylene-p-monononyl-phenylether (average polymerization degree = 10) | 0.3 g | 0.3 g |
| Polymaleic acid (average molecular weight = 2,000) | 0.1 g | 0.15 g |
| Water to make | 1,000 mL | 1,000 mL |
| pH | 7.0 | 7.0 |

In the above-mentioned development process, the respective solutions were continuously circulated to stir the solutions. Further, the bottom of each tank had provided with small holes a diameter of 0.3 mm and arranged at an interval of 1 cm, to which blowing pipes were connected, through which nitrogen gas was continuously blown to effect stirring.

<Comparison Between Samples>

Various modifications as described below were made on the sample 101 to see how the color reproduction was influenced.

The sensitivity, gradation and the like, though changed by the modifications, were adjusted to the same levels as the sample 101 by the known method, such as the emulsion sensitivity adjustment carried out when the grain sizes were changed.

Incidentally, the weight-averaged wavelength of spectral sensitivity distribution of the red-sensitive emulsion layer in the samples 101–113 was 640 nm, that of the green-sensitive emulsion layer in the samples 101–113 was 550 nm, and that of the long wavelength blue-sensitive emulsion layer was 465 nm.

(1) Influences by the provision of the short wavelength blue-sensitive emulsion layer and the silver halide content of the grains contained in the short wavelength blue-sensitive emulsion layer The short-wavelength blue-sensitive emulsion layer (12th layer) was removed from the sample 101 to prepare sample 100.

Further, samples 102 to 106 were prepared by replacing the emulsion VL-1 used for the 12th layer of the sample 101 with the emulsions the VL-2 to VL-6, respectively.

The prepared samples were each cut into a Brownie camera size with a width of 60 mm and processed, and then were mounted in a Brownie camera to photograph the Macbeth color chart under daylight. Then the above-mentioned development process was carried out, and the color reproduction was visually confirmed. Further, minute variations of the color reproduction were evaluated by measuring the RGB concentration of the photographed image, plotting the measured concentration on the Lab chromaticity diagram, and confirming the relative positional relation with the chromaticity diagram plot of the color of the Macbeth chart itself.

Comparing the samples 101 to 106, the discrimination property of hue from blue to purple colors was enhanced by changing the average silver iodide content of the grains contained in said emulsion from 1.5 mol %→2 mol %→4 mol %→8 mol %→12 mol %→24 mol %. In particular, when the average silver iodide content is 4 mol % or more, the saturation from green to red colors was also improved. However, when the average silver iodide content is 1.5 mol % (sample 101), the difference was small between the sample 101 and sample 100 (the short-wavelength blue-sensitive emulsion layer removed).

(2) Influence of λv

Samples 107 to 109 were prepared using the VL-7 to VL-9 in place of the emulsion VL-5 contained in the short-wavelength blue-sensitive emulsion layer of the sample 105. The samples 107 and 108 had a high discrimination property of hue from blue to purple colors, like the sample 105. However the discrimination property was deteriorated in the sample 109, and the difference was small between the sample 109 and the sample 100 (the short-wavelength blue-sensitive emulsion layer removed).

(3) Influence of introduction of a color-forming coupler into a short-wavelength blue-sensitive emulsion layer Yellow coupler C-8 was added, with its addition amount changed, to the short-wavelength blue-sensitive emulsion layer of the sample 105 (12th layer) to prepare samples 110 to 112. The discrimination property of hue from blue to purple colors was enhanced in the samples 110 and 111 as in the sample 105. However, although the sample 112 had the preferable discrimination property of hue from blue to purple colors in the sample 105, but the saturation of blue color was lowered.

(4) Influence of the position of a short-wavelength blue-sensitive emulsion layer The short-wavelength blue-sensitive emulsion layer (12th layer) of the sample 105 was removed and a layer having the same composition as the 12th layer was provided between the 15th layer and the 16th layer to prepare a sample 113. Similar effects to the sample 105 were also obtained by the sample 113.

EXAMPLE 2

Cyan coupler C-3 was added to the 12th (VL) layer in the sample 105 of Example 1 to prepare a sample 201. The maximum cyan color density of the layer was 0.3. The discrimination property of hue from blue to purple colors was also enhanced in the sample 201 as in the sample 105, and additionally, the hue fidelity of intermediate colors from red to orange colors was enhanced.

EXAMPLE 3

Fine grain silver iodide emulsion (average grain size of 0.06 μm) was added in a silver amount of 0.06 g/m$^2$ to the 12th layer (VL layer) of the samples 102 and 105 of Example 1, respectively, to prepare samples 301 and 302. Similarly, fine grain silver iodobromide emulsion (average grain size of 0.07 μm and silver iodide content of 1 mol %) was added in a silver amount of 0.06 g/m$^2$ to the 12th layer of the samples 102 and 105, respectively, to prepare samples 303 and 304.

Further, in the samples 102 and 105, a layer, in which a fine grain silver iodide emulsion (average grain size of 0.06 μm) was present in a silver amount of 0.06 g/m$^2$, was introduced between the 12th (VL) layer and the 11th layer, respectively, to prepare samples 305 and 306. Similarly, a layer, in which a fine grain silver iodobromide emulsion (average grain size of 0.07 μm and silver iodide content of 1 mol %) was present in a silver amount of 0.06 g/m$^2$, was introduced between the 12th layer and the 11th layer of the samples 102 and 105, respectively, to prepare samples 307 and 308.

All of the samples 301 to 308 had a preferable discrimination property of hue from blue to purple colors as in the samples 102 and 105, and the saturation from green to red colors was improved.

EXAMPLE 4

Samples 401 and 402 were prepared following the same procedures as for samples 102 and 105 in Example 1, respectively, except that between the 1st layer (antihalation layer) and the 2nd layer (the first interlayer), a short-wavelength green-sensitive emulsion layer was provided which was prepared by coating a silver iodobromide emulsion whose grains had an equivalent-sphere average grain diameter of 0.5 μm, a variation coefficient of the equivalent-sphere diameters of 15%, a silver iodide content of 6 mol %, and a weight-averaged wavelength of spectral sensitivity distribution of 544 nm such that the coated silver amount was 0.3 g/m$^2$.

The samples 401 and 402 were further improved over the samples 102 and 105 in the discrimination from blue to bluish green colors, giving more preferable results.

What is claimed is:

1. A silver halide color photographic material comprising at least one blue-sensitive emulsion layer, at least one green-sensitive emulsion layer and at least one red-sensitive emulsion layer, on a support, the photographic material further including at least one short-wavelength blue-sensitive emulsion layer (VL layer) that has a weight-averaged wavelength (λv) of spectral sensitivity distribution of 400 nm≦λv≧460 nm and that is substantially free a yellow coupler.

2. The photographic material according to claim 1, wherein an average silver iodide content of silver halide grains contained in said VL layer is 2 mol % or more and 39 mol % or less.

3. The photographic material according to claim 1, wherein said VL layer contains a cyan coupler.

4. The photographic material according to claim 2, wherein said VL layer contains a cyan coupler.

5. The photographic material according to claim 1, wherein a non-lightsensitive fine grain emulsion is present in said VL layer or an adjacent layer thereof.

6. The photographic material according to claim 2, wherein a non-lightsensitive fine grain emulsion is present in said VL layer or an adjacent layer thereof.

7. The photographic material according to claim 3, wherein a non-lightsensitive fine grain emulsion is present in said VL layer or an adjacent layer thereof.

8. The photographic material according to claim 4, wherein a non-lightsensitive fine grain emulsion is present in said VL layer or an adjacent layer thereof.

9. A method of forming a color reversal image comprising subjecting a silver halide color photographic material according to claim 1 to a black-and-white development, and then to a color development.

10. A method of forming a color reversal image comprising subjecting a silver halide color photographic material according to claim 2 to a black-and-white development, and then to a color development.

11. A method of forming a color reversal image comprising subjecting a silver halide color photographic material according to claim 3 to a black-and-white development, and then to a color development.

12. A method of forming a color reversal image comprising subjecting a silver halide color photographic material according to claim 4 to a black-and-white development, and then to a color development.

13. A method of forming a color reversal image comprising subjecting a silver halide color photographic material according to claim 5 to a black-and-white development, and then to a color development.

14. A method of forming a color reversal image comprising subjecting a silver halide color photographic material according to claim 6 to a black-and-white development, and then to a color development.

15. A method of forming a color reversal image comprising subjecting a silver halide color photographic material according to claim 7 to a black-and-white development, and then to a color development.

16. A method of forming a color reversal image comprising subjecting a silver halide color photographic material according to claim 8 to a black-and-white development, and then to a color development.

* * * * *